US007773900B2

(12) United States Patent
Sakamaki

(10) Patent No.: US 7,773,900 B2
(45) Date of Patent: Aug. 10, 2010

(54) IMAGE FORMING APPARATUS AND CONTROLLING FEATURE FOR DEVIATING TONER STRIPES TRANSFERRED TO AN INTERMEDIATE TRANSFER MEDIUM

(75) Inventor: Tomoyuki Sakamaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/261,290

(22) Filed: Oct. 30, 2008

(65) Prior Publication Data

US 2009/0066982 A1 Mar. 12, 2009

Related U.S. Application Data

(63) Continuation of application No. 11/247,288, filed on Oct. 12, 2005, now Pat. No. 7,454,149.

(30) Foreign Application Priority Data

Oct. 20, 2004 (JP) ..... 2004-306255
Oct. 20, 2004 (JP) ..... 2004-306258

(51) Int. Cl.
*G03G 15/02* (2006.01)

(52) U.S. Cl. ..... 399/50; 399/55; 399/66; 399/71

(58) Field of Classification Search ..... 399/55, 399/66, 71, 50, 302
See application file for complete search history.

(56) References Cited

U.S. PATENT DOCUMENTS 7,454,149 B2 * 11/2008 Sakamaki ..... 399/50

FOREIGN PATENT DOCUMENTS

JP 2002-207403 7/2002
JP 2003-280483 10/2003

* cited by examiner

*Primary Examiner*—David P Porta
*Assistant Examiner*—Bryan P Ready
(74) *Attorney, Agent, or Firm*—Fitzpatrick, Cella, Harper & Scinto

(57) ABSTRACT

The image forming apparatus includes image forming parts, a developing device and a cleaner to clean at least the intermediate transfer material or the transfer device, wherein at the image forming operation starting time, in each image forming part, after starting the charging, the application of the developing bias is started before the top end of the charging portion of the image bearing member surface reaches a developing area in which the image bearing member and the developer bearing member are set against each other, and from among the areas on the image bearing member in which the charging is not yet performed in each image forming part, in case each area having passed the developing area when the developing bias is applied is brought into contact with the intermediate transfer member, the contact area with each area in the intermediate transfer member is controlled without superposing on the intermediate transfer member.

10 Claims, 12 Drawing Sheets

IMAGE FORMING APPARATUS AND CONTROLLING FEATURE FOR DEVIATING TONER STRIPES TRANSFERRED TO AN INTERMEDIATE TRANSFER MEDIUM

This application is a continuation of U.S. patent application Ser. No. 11/247,288, filed Oct. 12, 2005.

BACKGROUND OF THE INVENTION

1. Field of the Invention

The present invention relates to an image forming apparatus, which forms a toner image on an image bearing member, and transfers the toner image on a transfer material, thereby forming an image on the transfer material.

2. Related Background Art

In general, as a four-color full color image forming apparatus, there has been known an image forming apparatus comprising four pieces (four-colors) of image forming parts forming a different color toner image, respectively. Four pieces of image forming parts are lined up and disposed from an upper stream side to a down stream side along the moving direction of an intermediate transfer belt, and each color toner image formed by each image forming part is primary-transferred in order on an intermediate transfer belt, and the four-color toner images are superposed on the intermediate transfer belt. After that, these four-color toner images on the intermediate transfer belt are secondary-transferred collectively on the transfer material, and these four-color toner images are heated by a fixing apparatus, thereby fixing a four-color full color toner image on the transfer material.

Here, an applied starting timing and an applied stopping timing of a developing bias voltage and a charging bias voltage at the recording operation (image forming operation) starting time and the recording operation (image forming operation) completing time will be described.

In each image forming part, at the recording operation starting time, the photosensitive drum, when coming to stable rotation, drives a charge device to start charging. When an area where the photosensitive drum surface and the developer held in the developing sleeve of the developing device are brought into contact is taken as a developing area, the photosensitive drum surface coming close to the developer sleeve is 0 [V] until a charged area (hereinafter referred to as "a charging portion") within the photosensitive drum surface reaches a developing area N. Consequently, in case the developing bias voltage (for example, −550 [V]) of the developing sleeve is turned on until the charging portion on the photosensitive drum reaches the developing area, a large contrast potential Vcont (=|0−(−550)|=550 [V]) is formed in the whole photosensitive drum surface area which passes through the developing area, a toner within the developer ends up adhering to a non-image part before the developing starting time. As a result, a toner stripes image is formed before the image part in the transfer material P.

On the other hand, to prevent the toner from adhering to the non image part, the developing bias voltage of the developer sleeve may be turned on after the top end of the charging portion of the photosensitive drum surface charged to a surface potential Vd (for example, −700 [V]) completely passes through the developing area. However, under such situation, before the developing bias voltage is turned on (when the developer sleeve is 0 [V]), since a portion of the photosensitive drum surface charged to Vd (=−700 [V]) passes through the developing area, at this time, between the developing sleeve and the photosensitive drum surface, there is formed a large fog-taking potential Vback (=|−700−0|=700 [V]) is formed, and in case a two component developer comprising a toner and a carrier is used as the developer, there arises a problem that the carrier in the developer adheres to the photosensitive drum surface.

To prevent not only the toner but also the carrier from adhering, though the developing bias voltage may be turned on simultaneously in timing of the charging portion on the photosensitive drum reaching the developing area, in reality when considering various types of deviations, it is difficult to allow on-timing to be completely matched every time. Further, since the developing area has some constant width, even from that view point, it is difficult to allow the timing to be matched. As a result, either the carrier or the toner on the developing sleeve ends up adhering to the photosensitive drum. Particularly, when the carrier of the developing sleeve flies to the photosensitive drum, the carrier harms the photosensitive drum surface by a cleaning blade of a cleaning device to clean the photosensitive drum surface, thereby shortening the life of the photosensitive drum. Hence, heretofore, by turning on the bias voltage of the developing sleeve immediately before the top end of the photosensitive drum surface charged to Vd (=−700 [V]) by the charging device reaches the developing area, the adherence of the carrier is completely prevented. As a result, a toner stripes image has been formed before the image part. The toner is different from the carrier, and is hard to harm the photosensitive drum by the cleaning blade. When configured in such a manner, though there arises a problem that the amount of consumption of the toner increases, there is no increase in the adherence of the carrier with the photosensitive drum, and it has been possible to maintain an excellent image for a long period of time (Japanese Patent Application Laid-Open No. 2003-280483).

On the other hand, at the recording operation completing time also, since a problem similarly to the recording operation starting time arises, the rear end of the charging portion of the photosensitive drum surface charged to Vd (=−700 [V]) by the charging device has turned off the developing bias voltage toward the developing sleeve immediately after having passed the developing area.

As described above, as the application starting timing and the application stopping timing of the developing bias voltage and the charging bias voltage at the recording operation staring time and the recording operation completing time in which the above described configuration is used, instead of the carrier not adhering to the photosensitive drum, a toner image with toner stripes (toner stripes image) is formed before and behind the image part.

This toner stripes image is once transferred on the intermediate transfer belt by a primary transfer roller, and after that, it is conveyed up to a secondary transfer roller. Here, though the toner image of the image part is transferred on the transfer material, the toner stripes image before and behind the image part is not transferred on the transfer material, but on the secondary transfer roller, and smears the secondary transfer roller. To remove such smearing, it has been quite usual for a secondary transfer roller cleaner to be provided.

Now, in the four-color full color image forming apparatus, if the timing of the application and the stopping is set up as described above, the toner stripes image is formed before and behind the image part for each color. These toner stripes images are transferred together on the intermediate transfer belt 7 when the toner image of each color is primary-transferred on the intermediate transfer belt by electrical operation and pressing force of the primary transfer roller. At this time, while four-color toner images are superposed on the intermediate transfer belt, similarly, the toner stripes images are also superposed for four-colors on the intermediate transfer belt.

As a result, these toner stripes images are conveyed up to a secondary transfer portion with four-colors superposed in the four-color full color image forming apparatus.

And yet, this toner stripes image, as described above, is subjected to a developing step with an extremely large contrast potential Vcont (=550 [V]) since the developing sleeve is applied with the developing bias voltage Vd (=−550 [V]) when the surface potential of the photosensitive drum is 0 [V]. Usually, the surface potential V1 of the photosensitive drum of a solid image part often uses a value smaller than 0 [V] in view of stability (for example, −200 [V]), and as a result, even when comparing with the contrast potential Vcont (=|V1−Vdc|=|−200+550|=350 [V]) at the usual solid image forming time, the toner stripes image before and behind the image part has an extremely large amount of toner loaded. That is, before and behind the four-color full color toner image on the intermediate transfer belt, there is formed a toner stripes image superposed with the toner more than equivalent to the solid images for four-colors.

After that, following the rotation of the intermediate transfer belt, the four-color toner image and the toner stripes image are conveyed up to the secondary transfer portion, and from among them, while the four-color toner image is transferred on the transfer material, the toner stripes image formed before and behind the image part does not contact the transfer material, but directly contacts a secondary transfer roller 9, and ends up being transferred on the secondary transfer roller by electrical operation and pressing force of the secondary transfer roller. As a result, the secondary transfer roller is smeared.

Although such smearing can be removed by the above-described secondary transfer roller cleaner, this cleaner sometimes is unable to remove the smear by one time cleaning only for the toner stripes image superposed with four-colors. When the rear surface of the transfer material contacts the smeared portion in the next step, there arises a problem that the rear surface of the transfer material ends up being smeared. Particularly, depending on the material of the secondary transfer roller, there are the cases where the cleaning removal is difficult. For example, in case the surface shape of the secondary transfer roller is in a dilapidated state, it is difficult to be removed, and the above described problem is prone to occur.

In contrast to this, there is a method available, in which the secondary transfer roller is allowed to rotate for several turns in a state in which no image is formed, and after the cleaning of the secondary transfer roller is completely performed, the supply of the transfer material is made so as to restart the image formation. However, since the image formation is not possible to be performed during such cleaning of the secondary transfer roller, if sufficient cleaning of the secondary transfer roller is awaited, the lowering of efficiency is invited.

Further, when the toner stripes images for four-colors are conveyed to the secondary transfer portion, the secondary transfer roller is applied with a second transfer bias voltage of the polarity in reverse to the usual polarity, so that the smearing of the secondary transfer roller can be prevented. However, at this time, the similar problem arises in the intermediate transfer belt cleaning material provided on the intermediate transfer belt of the down stream of the secondary transfer portion, and the smearing of the rear surface of the transfer material or the lowering of the efficiency occurs.

SUMMARY OF THE INVENTION

Hence, to prevent the carrier adherence in plural image forming parts, the present invention prevents a cleaning failure from being invited by preventing the toner adherence from being arisen and superposed for plural image forming parts when a developing bias is applied on the image bearing member surface in which the charging is not yet performed.

A preferred image forming apparatus to achieve the above described object comprises:

plural image forming parts, each part including:

an image bearing member in which an electrostatic image is formed;

charging means to charge the image bearing member; and developing means to perform development of the electrostatic image by carrying the developer including a carrier and a toner on a developer bearing member and by applying a developing bias to the developer bearing member;

transfer means to superpose toner images formed by each of the plural image forming parts on an intermediate transfer member and, after that, collectively transfer them on a transfer material;

means to clean at least the intermediate transfer member or the transfer means; and control means to control the operation of charging means and the developing means;

wherein the control means, at the image forming operation starting time, after starting the charging by the charging means in each image forming part, starts the application of the developing bias before the top end of the charging portion of the image bearing member surface reaches a developing area in which the image bearing member and the developer bearing member are set against each other, and wherein, from among the areas on the image bearing member where the charging is not yet performed by the charging means in each image forming part, in case each area having passed the developing area when the developing bias is applied is brought into contact with the intermediate transfer member, the contact area with each area in the intermediate transfer member is controlled so as not to be superposed on the intermediate transfer member.

Another preferred image forming apparatus comprises:

plural image forming parts, each part including:

an image bearing member in which an electrostatic image is formed;

charging means to charge the image bearing member; and developing means to perform development of the electrostatic image by bearing the developer including a carrier and a toner on a developer bearing member and applying a developing bias to the developer bearing member;

transfer means to superpose and transfer the toner image formed by each of plural image forming parts on a transfer material borne and conveyed by a transfer material conveying member;

means to clean the transfer material conveying member; and control means to control the charging means and the operation of developing means;

wherein the control means, at the image forming operation starting time, in each image forming part, after starting the charging by the charging means starts the application of the developing bias before the top end of the charging portion of the image bearing member surface reaches the developing area in which the image bearing member and the developer bearing member are set against each other, wherein, from among the areas on the image bearing member in which the charging is not yet performed by the charging means in each of the image forming parts, in case each area having passed the developing area when the developing bias is applied is brought into contact with the intermediate transfer member, the contact area with each area in the intermediate transfer member is controlled so as not to be superposed on the intermediate transfer member.

Another preferred image forming apparatus comprises:

plural image forming parts, each part including:

an image bearing member in which an electrostatic image is formed;

charging means to charge the image bearing member; and developing means to perform development of the electrostatic image by bearing the developer including a carrier and a toner on a developer bearing member and applying a developing bias to the developer bearing member;

transfer means to superpose toner images formed by each of the plural image forming parts on an intermediate transfer member and, after that, collectively transfer them on the transfer material;

means to clean at least the intermediate transfer member or the transfer means;

control means to control the charging means and the operation of the developing means;

wherein the control means, at the image forming operation completing time, in each image forming part, completes the application of the developing bias after the rear end of the charging portion of the image bearing member surface passes through the developing area in which the image bearing member and the developer bearing member are set against each other, wherein, from among the areas on the image bearing member where the charging is not yet performed by the charging means in the each image forming parts, in case each area having passed the developing area when the developing bias is applied is brought into contact with the intermediate transfer member, the contact area with each area in the intermediate transfer member is controlled so as not to be superposed on the intermediate transfer member.

Another preferable image forming apparatus comprises:

plural image forming parts, each part including:

an image bearing member in which an electrostatic image is formed;

charging means to charge the image bearing member; and developing means to perform development of the electrostatic image by carrying the developer including a carrier and a toner on a developer bearing member and by applying a developing bias to the developer bearing member;

transfer means to superpose and transfer the toner image formed by each of plural image forming parts and on the transfer material borne and conveyed by the transfer material conveying member;

means to clean the transfer material conveying member;

control means to control the charging means and the operation of developing means, wherein the control means, at the image forming operation starting time, in each image forming part, completes the application of the developing bias after the rear end of the charging portion of the image bearing member surface passes through the developing area in which the image bearing member and the developer bearing member are set against each other, wherein, from among the areas on the image bearing member in which the charging is not yet performed by the charging means in each of the image forming part, in case each area having passed the developing area when the developing bias is applied is brought into contact with the intermediate transfer member, the contact area with each area in the intermediate transfer member is controlled so as not to be superposed on the intermediate transfer member.

DESCRIPTION OF THE PREFERRED EMBODIMENTS

Embodiments of the present invention will be described below with reference to the drawings.

First Embodiment

Figure 1:
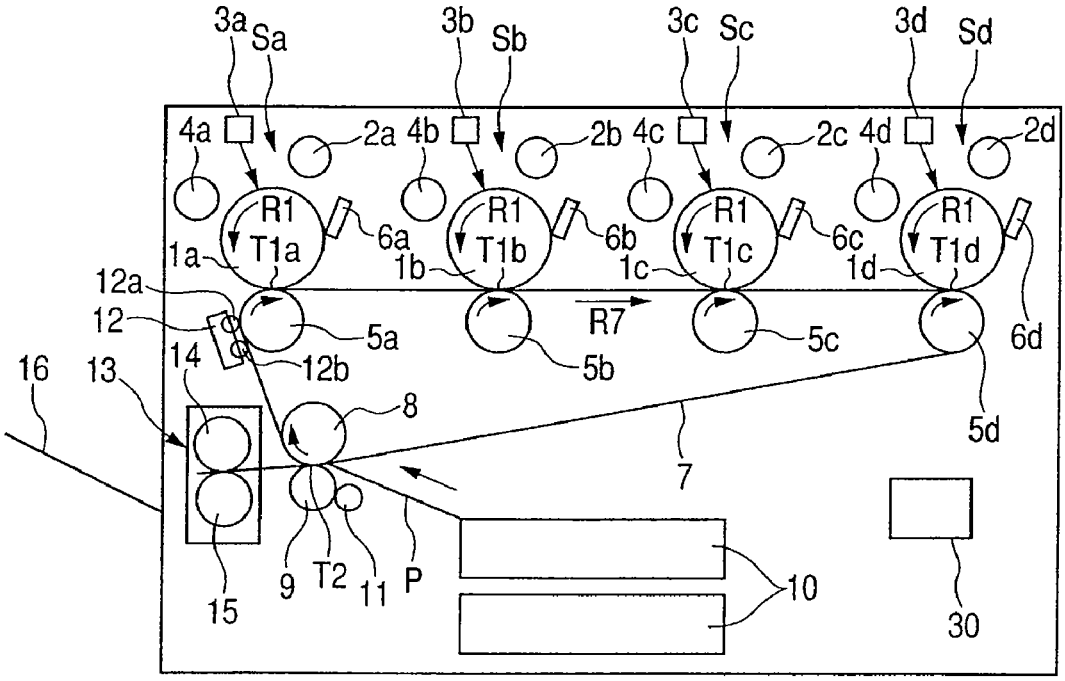
FIG. 1 is a longitudinal sectional view showing a schematic structure of an image forming apparatus applicable to the present invention.

In FIG. 1 is shown an image forming apparatus applicable to the present invention. The image forming apparatus shown in the Figure is a four-color full color image forming apparatus having four pieces of image forming parts of an electrophotographic system, and the Figure is a longitudinal sectional view schematically showing its schematic structure.

The image forming apparatus shown in the Figure is disposed with four pieces of image forming parts (image forming stations) Sa, Sb, Sc, and Sd from the upper stream side to the down stream side along the rotational direction (the direction to an arrow mark R7) of an intermediate transfer belt 7 as an intermediate transfer member.

Each of the image forming parts Sa, Sb, Sc, and Sd is an image forming part to form a toner image of each color of yellow, magenta, cyan, and black in this order, and comprises a drum shaped electrophotographic photosensitive member (hereinafter referred to as [photosensitive drum]) 1*a*, 1*b*, 1*c*, and 1*d* as an image bearing member, respectively.

The photosensitive drums 1*a*, 1*b*, 1*c*, and 1*d* are rotationally driven in the direction to an arrow mark R1 (counterclockwise direction in the FIG. 1), respectively. The circumference of each photosensitive drum 1*a*, 1*b*, 1*c*, and 1*d* is disposed with in order approximately along its rotational direction charging devices (charging means) 2*a*, 2*b*, 2*c*, and 2*d*, exposing apparatus (latent image forming means) 3*a*, 3*b*, 3*c*, and 3*d*, developing devices (developing means) 4*a*, 4*b*, 4*c*, and 4*d*, and primary transfer rollers (primary transfer means) 5*a*, 5*b*, 5*c*, and 5*d*, and drum cleaners (cleaning apparatus) 6*a*, 6*b*, 6*c*, and 6*d*. The primary rollers 5*a*, 5*b*, 5*c*, and 5*d* and a secondary transfer opposing roller 8 are spanned with an endless intermediate transfer belt 7 as an intermediate transfer member. The intermediate transfer belt 7 is pressed from its rear surface by the primary transfer rollers 5*a*, 5*b*, 5*c*, and 5*d*, and its front surface is abutted against the photosensitive drums 1*a*, 1*b*, 1*c*, and 1*d*. In this manner, between the photosensitive drums 1*a*, 1*b*, 1*c*, and 1*d* and the intermediate transfer belt 7, there are formed primary transfer developing areas (primary transfer portions) T1*a*, T1*b*, T1*c*, and T1*d*. The intermediate transfer belt 7 is rotated in the direction to the arrow mark R7 following the rotation in the direction to an arrow mark R8 of the secondary transfer opposing roller 8, which serves as a driving roller also. The rotational speed of this intermediate transfer belt 7 is set almost to the same rotational speed (process speed) of each of the photosensitive drums 1*a*, 1*b*, 1*c*, and 1*d*.

At a position corresponding to the secondary transfer opposing roller 8 in the surface of the intermediate transfer belt 7, there is disposed a secondary transfer roller (secondary transfer means) 9. The secondary transfer roller 9 developing areas the intermediate transfer belt 7 between it and the secondary transfer opposing roller 8, and between the secondary transfer roller 9 and the intermediate transfer belt 7, there is formed a secondary transfer developing area (secondary transfer portion) T2. Against this secondary transfer roller 9, there is abutted a roller cleaner (secondary transfer member cleaner) 11. Further, against the position corresponding to a primary transfer roller 5*a* in the surface of the intermediate transfer belt 7, there is abutted a belt cleaner (intermediate transfer member cleaner) 12. The belt cleaner 12 comprises cleaning members 12*a* and 12*b* to perform cleaning by abutting against the intermediate transfer belt.

A transfer material P supplied to the image formation is stored in a state loaded on a paper feeding cassette 10. This transfer material P is supplied to the secondary transfer developing area portion T2 by a sheet conveying apparatus having a paper feeding roller, a conveying roller, registration roller and the like (any one of them not illustrated). At the down stream side of the secondary transfer developing area portion T2 along the conveying direction of the transfer material P, there is disposed a fixing apparatus 13 having a fixing roller 14 and a pressure roller 15 pressed by this roller, and further at the down stream side of the fixing apparatus 13, there is disposed a sheet discharging tray 16.

In the image forming apparatus configured as described above, a four-color full color toner image is formed on the transfer material P in the following manner.

First, the photosensitive drums 1*a*, 1*b*, 1*c* and 1*d* are rotationally driven at a predetermined process speed in the arrow direction by a photosensitive drum driving motor (not shown), and are uniformly charged to predetermined polarity and potential by charging devices 2*a*, 2*b*, 2*c*, and 2*d*. The photosensitive drums 1*a*, 1*b*, 1*c*, and 1*d* after charged are subjected to exposure based on image information by exposing apparatuses 3*a* to 3*d*, and the electric charge of the exposed portion is removed, so that an electrostatic latent image of each color is formed.

These electrostatic latent images on the photosensitive drums 1*a*, 1*b*, 1*c*, and 1*d* are developed as the toner images of each color of yellow, magenta, cyan, and black by the developing devices 4*a*, 4*b*, 4*c*, and 4*d*. These four-color toner images are primary-transferred in order on the intermediate transfer belt 7 by the primary transfer rollers 5*a*, 5*b*, 5*c*, and 5*d* in the primary transfer developing areas T1*a*, T1*b*, T1*c*, and T1*d*. Thus, the four-color toner images are superposed on the intermediate transfer belt 7. At the primary transfer time, the toners (residual toners) not transferred on the intermediate transfer belt 7 but left behind on the photosensitive drums 1*a*, 1*b*, 1*c*, and 1*d* are removed by the drum cleaners 6*a*, 6*b*, 6*c*, and 6*d*. The photosensitive drums 1*a*, 1*b*, 1*c*, and 1*d* having been removed from the residual toners are supplied for the next image forming.

The four-color toner images superposed on the intermediate transfer belt 7 as described above are secondary-transferred on the transfer material P. The transfer material P conveyed from the paper feeding cassette 10 by the sheet conveying apparatus is supplied to the secondary transfer developing area T2 timed with the toner image on the intermediate belt 7 by the registration roller. The supplied transfer material P is collectively secondary-transferred with the four-color toner images on the intermediate transfer belt 7 by the secondary transfer roller 9 in the secondary transfer developing area T2. At the secondary transfer time, the toners (residual toners) not transferred on the transfer material P but left behind on the intermediate transfer belt 7 are removed by the belt cleaner 12.

On the other hand, the transfer material P secondary-transferred with four-color toner images is conveyed to the fixing apparatus 13, and here, the transfer material P is heated and pressured, and is fixed with the toner images on the surface. The transfer material P after fixed with the toner images is discharged on the paper discharge tray 16. Thus, the image formation of a four-color full color for one side (front surface) of a sheet of the transfer material P is completed.

Here, a portion relating to the present invention will be described in detail. In the following description, with respect to the photosensitive drums 1*a*, 1*b*, 1*c*, and 1*d*, the charging devices 2*a*, 2*b*, 2*c*, and 2*d*, the exposing apparatuses 3*a*, 3*b*, 3*c*, and 3*d*, the developing devices 4*a*, 4*b*, 4*c*, and 4*d*, the primary transfer rollers 5*a*, 5*b*, 5*c*, and 5*d*, and the drum cleaners 6*a*, 6*b*, 6*c*, and 6*d*, unless there is any particular need to distinguish colors, they are simply described as a photosensitive drum 1, a charging device 2, an exposing apparatus 3, a developing device 4, a primary transfer roller 5, and a drum cleaner 6.

Figure 2:
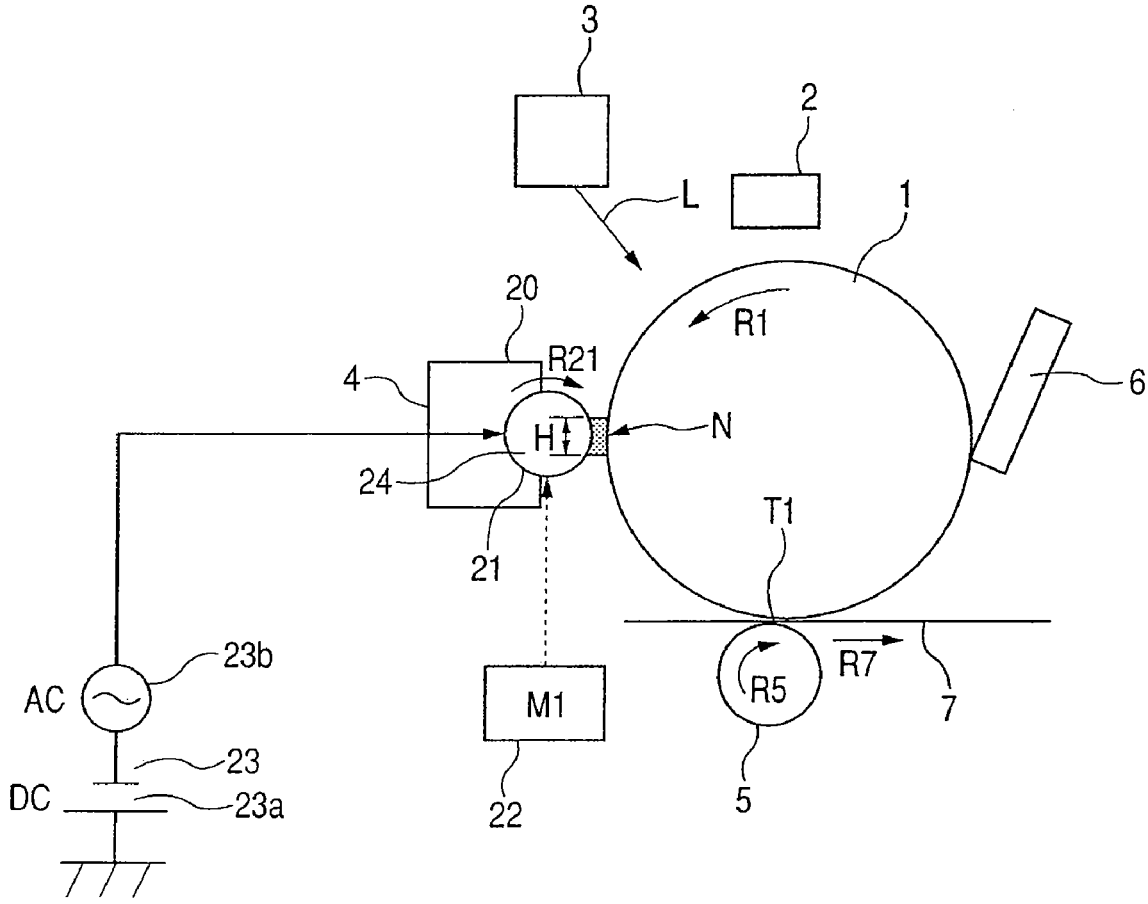
FIG. 2 is an enlarged longitudinal sectional view in the vicinity of an image formatting portion.

In FIG. 2 is shown an enlarged view of the vicinity of the photosensitive drum 1.

When the image formation is performed, the photosensitive drum 1 is rotationally driven at a predetermined process speed in the direction to the arrow mark R1 by the photosensitive drum driving motor, and is uniformly charged to predetermined polarity and potential by the charging device 2. In the present embodiment, the photosensitive drum 1 is charged to a surface potential (dark portion potential) Vd=−700[V]. The photosensitive drum 1 surface after charged receives an exposure L based on the image information by the exposing apparatus 3, and the electrical charge of the exposed portion is removed, thereby forming an electrostatic latent image. Hereinafter, a portion where the electrostatic latent image is formed by the exposure is referred to as [image part (light portion)], and the portion where the exposure is not received is referred to as [non image part (dark portion)]. This image part has a high potential (for example, the light portion potential V1=−200[V]), comparing with the non-image part.

The developing device 4 is disposed at the down stream side along the rotational direction (direction to the arrow mark R1) of the photosensitive drum 1 than the charging device 2. The charging device 4 has a developer container 20 to store a developer, a developing sleeve 21 which is a developer bearing member, a motor 22 to rotationally drive this developing sleeve 21, and a developing bias applied power source 23 to apply a developing bias voltage to the developing sleeve 21. The surface of the developing sleeve 21 is borne with the toner charged negatively. Further, the developing sleeve 21 is applied with the developing bias voltage by the developing bias applied power source 23. By the application of this developing bias voltage, when the image part on the photosensitive drum 1 passes through the vicinity of the developing sleeve 21, the toner borne on the developing sleeve 21 surface is adhered to the image part on the photosensitive drum 1, so that the toner image is formed.

Heretofore, in the color image forming apparatus to form a full color image and a multi color image by the electrophotographic system, in view of coloring properties and color mixing properties, almost all the developing devices 4 use a two component developer mixing a toner and a carrier. In a two component developing process, the developer comprising the toner charged negatively and the carrier charged positively on the surface of the developing sleeve 21 is held. To fly this toner to the image part of the surface of the photosensitive drum 1, the developing bias voltage which is lower in potential than the image part but higher in potential than the non-image part is applied to the developing sleeve 21.

Particularly, in recent years, to improve developing capability, as the developing bias voltage of the developing sleeve 21, a (DC+AC) bias system to superpose the DC component (for example, Vdc=−550[V]) with an AC component (for example, 2.0 k [V]) has come to be adapted.

The difference between a dark portion potential Vd of the non-image part and the DC component Vdc of the developing bias is referred to as a fog taking potential Vback (=|Vd−Vdc|), and usually it is set to become approximately 100 to 200 [V]. If it is made smaller than this value, the non-image part becomes prone to be fogged. On the other hand, when it is made larger, the adherence amount of carrier is prone to increase. Further, the difference between a light portion potential V1 of the image part and the DC component Vdc of the developing bias is referred to as a contrast potential Vcont (=|V1−Vdc|) potential, and larger this contrast potential Vcont becomes, larger the loading amount of the toner on the photosensitive drum becomes. Usually, by adjusting this contrast potential, the density of the toner image on the photosensitive drum can be adjusted to the desired density.

The developing device 4 and the developer will be further described.

In the present embodiment, the developing device 4 adopts a two component magnetic brush system. Inside the developer container 20 of the developing device 4 shown in FIG. 2, there is stored a two component developer mainly comprising a magnetic carrier particle (suitably called as [carrier]) and a toner particle (suitably called as [toner]). Inside the developing sleeve 21, there is disposed a magnet roller 24. This magnet roller 24 is fixed, and the outer developing sleeve 21 is rotated in the direction to an arrow mark R21 by the motor 22. In the surface of the developing sleeve 21, there is configured a magnetic brush of the two component developer by magnetic force of the magnet roller 24. Between the photosensitive drum 1 surface and the developing sleeve 21 surface, there is provided a micro space. The developing sleeve 21 is rotated in the direction to the arrow mark R21 by the motor 22, so that the magnetic brush of the surface is slidably rubbed on or closely drawn near to the photosensitive drum 1 surface. Further, the developing sleeve 21 is applied with the developing bias voltage by the developing bias applied power source 23. In this manner, the toner inside the magnetic brush of the developing sleeve 21 surface is adhered to the image part of the photosensitive drum 1, thereby developing this toner as a toner image.

In the present embodiment, the photosensitive drum 1 is 80 mm in diameter, and the developing sleeve 21 is 20 mm in diameter, and a distance at the closest area of approach (developing area N) between the photosensitive drum 1 surface and the developing sleeve 21 surface has been taken as approx 400 μm. In this manner, in a state in which the developer conveyed to the developing area N by the rotation in the direction to an arrow mark 21 of the developing sleeve 21 is brought into contact with the photosensitive drum 1, the developing is allowed to be performed.

At this time, in the present embodiment, the developing bias voltage in which a direct current component (DC component) is superposed with the alternating current component (AC component) is applied to the developer sleeve 21 by a direct current bias power source 23*a* and an alternating current bias power source 23*b* of the developing bias applied power source. By applying such developing bias voltage, there is formed an oscillatory electric field between the photosensitive drum 1 and the developing sleeve 21. By this oscillatory electric field, the toner is separated and flied from the carrier. In the present embodiment, as the alternating current component, an alternating current bias of frequency f=12 kHz and peak to peak voltage Vpp=1.85 kV is used.

The two component developer including the toner and the carrier used in the present embodiment will be described.

The toner has a binding resin, a coloring agent, a coloring resin particle including other additive agents as required, and a coloring particle externally added with an external additive agent such as a colloidal silica particle. The toner is a polyester system resin of negative electric charge properties, and is preferably above 4 μm and below 10 μm in weight average particle diameter. More preferably, the toner is below 8 μm in weight average particle diameter.

Further, the carrier can preferably use, for example, iron of surface oxidation or unoxidation, nickel, cobalt, manganese, chrome, metals such as rare earths, alloy of these metals, oxide ferrite, and the like. The manufacturing method of these magnetic particles is not particularly limited. The carrier is 20 to 60 μm or preferably 30 to 50 μm in weight average particle diameter, and is above $10^7$ Ω·cm or preferably above $10^8$Ω·cm in electrical resistivity. In the present embodiment, the carrier of $10^8$Ω·cm is used.

With respect to the toner used in the present embodiment, the weight average particle diameter is measured by the device and the method shown below. As a measuring device, a coulter counter model TA-II (made by Coulter Electronics Limited), an interface (made by Nikkaki Bios Co. Ltd.) for outputting number average distribution and weight average distribution, and a CX-I personal computer (made by Cannon Inc.) are used, and as hydroelectric solution, 1% NaCl solution conditioned by using first class sodium chloride is used.

The measuring method is as shown below. That is, as an interfacial active agent as an dispersing agent in the hydroelectric solution 100 to 150 ml, preferably alkylbenzene sulfonic acid is added 0.1 ml, and a measuring sample is added 0.5 to 50 mg. The hydroelectric solution in which the sample is suspended is subjected to distributed processing approximately for one to three minutes by an ultrasonic distributor, and particle size distribution of particles of 2 to 40 μm is measured by using a 100 μm aperture as an aperture by the coulter counter model TA-II to find weight average distribution. By the weight average distribution thus found, the weight average particle size is obtained.

Further, resistivity of the carrier used in the present embodiment is measured by the method of obtaining the resistivity of the carrier from the electric current flowing in a circuit by applying an applied voltage E (V/cm) between both electrodes under pressure of the weight of 1 kg for one electrode by using a sandwich type cell which is 4 $cm^2$ in the measured electrode area and disposed at intervals of 0.4 cm between electrodes.

The photosensitive drum 1 used in the present embodiment uses a photosensitive drum, which is a drum-shaped organic photosensitive member of normal use, that is, a photosensitive drum in which the surface of a cylindrical drum main board made of aluminum is provided with an OPC (organic photo conductor) having negative electrical charge characteristics as an photosensitive layer.

Here, referring to FIGS. 2 and 3, at the recording operation (image forming operation) starting time and the recording operation (image forming operation) stopping time, the content of a control of the developing bias voltage, a driving control of the photosensitive drum 1, and a driving control of the developing sleeve 21 will be described in detail. Such control of the operations of the developing device and the charging device is executed by control means 30.

Figure 3:
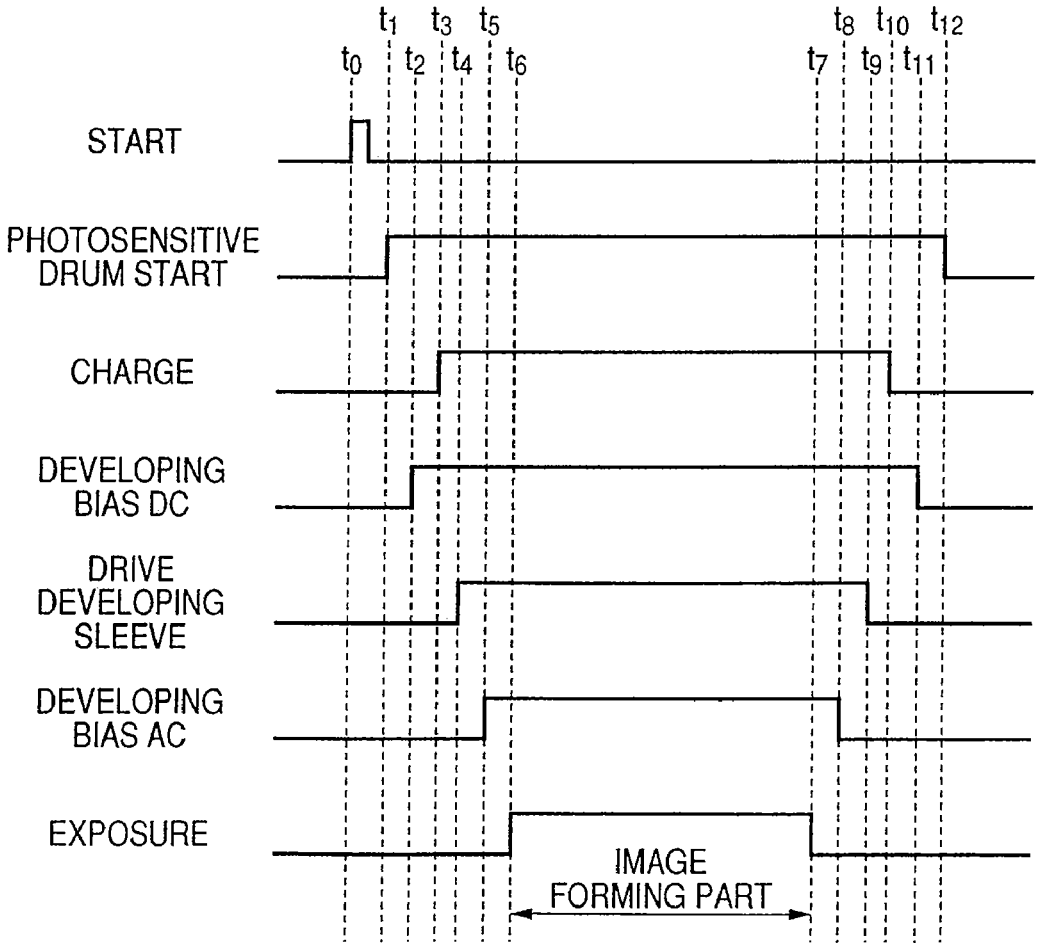
FIG. 3 is a time chart to explain a timing of driving, charging, developing and exposing of a photosensitive drum.

In FIG. 3 is shown a timing chart of the photosensitive drum driving, charging, developing, exposing and the like from the recording operation start until the recording operation stopping in the case of copying (image forming) for a sheet of the transfer material P. The timing chart of FIG. 3 is written on the basis of the developing area N. For example, the time in which the top ends of the charging portion and the image part reach the developing area N is taken as a timing of charging on and an exposing on, and on the other hand, the moment when each rear ends of these portions pass through the developing area N is taken as a timing of charging off and an exposing off. Hence, precautions are needed to take note that these timing charts are different from an actual time axis.

First, at a time t0, a start key of the operation panel (any of the component parts not shown) of the image forming apparatus main body is depressed, and after that, at a time t1, the driving of the photosensitive drum driving motor is started.

When the time comes in which the photosensitive drum 1 transmitted with the rotational driving force of the photosensitive drum driving motor starts stably rotating, the charging device 2 is controlled to start applying the charge voltage (Vd=−700[V]) to the photosensitive drum 1. In this manner, the photosensitive drum surface passing through an opposing portion between the charging device 2 and the photosensitive drum 1 is charged to −700 [V]. This charging portion reaches the developing area N by the rotation of the photosensitive drum 1.

In the present embodiment, at a time t3 immediately before the top end of the rotational direction of the photosensitive drum from among the charging portions reaches the developing area N, a control is made such that the developing sleeve 21 is applied with the DC component (Vdc=−550[V]) of the developing bias voltage.

The potential of the photosensitive drum surface located at the developing area N at the time t3 becomes 0 [V] because of a non-charging portion. On the other hand, the potential of the developing sleeve 21 is applied with DC bias of −550 [V], and the toner is adhered to the photosensitive drum surface located at the developing area N at the contrast potential of Vcont=550 [V]. Immediately after that, since the charging portion of the photosensitive drum surface charged with −750 [V] enters the developing area N, the developing area N has the developing potential raised from −550[V] to +200V (=−550−(−750)). Hence, after that, the adherence of the toner to the photosensitive drum surface is stopped. As a result, the photosensitive drum surface located at the developing area N is adhered with the toner stripes image.

If the developing bias voltage is applied after the charging portion passes through the developing area N, the adherence of the toner can be controlled. In its stead, the carrier coming to adhere to the surface of the photosensitive drum has been described in the paragraph of the Background Art. In the present embodiment also, in consideration of extensive harmful effects because of the carrier adherence, adherence of the toner stripes image is permitted by giving priority over the prevention of the carrier adherence.

The amount of toner adhered to the surface of the photosensitive drum at this time depends on a relative potential between the photosensitive drum surface and the developing sleeve surface in the developing area N. By turning the bias voltage of the developing sleeve 21 into the DC component only, comparing with the case where the bias voltage (DC+AC) superposed with the AC component on the DC component greatly higher in developing capability than the application of the DC component only is applied, the toner adherence amount can be sharply reduced.

Now, in the present embodiment, the DC component only is applied as the developing bias until the charging portion reaches the developing area N. In this manner, the adherence amount of the toner stripes image can be reduced. Further, in this manner, neither the carrier adherence amount is increased (on the contrary, the carrier also becomes difficult to adhere).

Further, in the present embodiment, as shown in FIG. 3, when the rotational driving of the photosensitive drum 1 is started at the time t1, the developing sleeve 21 rotationally driven by a driving system different from this photosensitive drum 1 is not yet rotationally driven. The developing sleeve 21 is controlled so as to be rotationally driven at a time t4 belonging to a period of time until the top end of the image part reaches the developing area N after the top end of the charging portion passes through the developing area N.

If controlled in this manner, there are the following advantages. That is, during the passage of the charging portion through the developing area N, as described above, the development of the toner is performed by high contrast potential. At this time, when the developing sleeve 21 is driven, during this time, the developing portion is continuously supplied with the toner, and there is a possibility that the width of the toner stripes image is widened. Particularly, in the image forming apparatus having a high process speed, it is remarkable. On the other hand, during this time, if the driving of the developing sleeve 21 is stopped, the toner which flies from the developing sleeve 21 to the photosensitive drum 1 is almost the toner, which is adhered to the position in opposite to the photosensitive drum 1. Immediately after the bias voltage of the DC component is applied to the developing sleeve 21, the toner adhered to the position in opposite to the photosensitive drum 1 flies over to the photosensitive drum 1 side, and at a point of time in which the belt of a developing area width is formed, no more toner is adhered to the drum 1, and therefore, the adhering width of the toner belt can be controlled to the extent of the developing area width.

When a predetermined period of time elapses from the time in which the DC component of the bias voltage is applied to the developing sleeve 21, a portion equivalent to the top end position of the transfer material P on the photosensitive drum surface reaches an exposing position by the rotation of the photosensitive drum 1. Further, when a predetermined period of time equivalent to the recording starting position from the top end of the transfer material elapses and comes to a time t5, the portion equivalent to the beginning head position (same as the top end of the image part) of an image size reaches an exposing position.

The exposing apparatus 3 completes the preparation of an electrostatic latent image formation by exposure by a time t5, and starts the formation of the electrostatic latent image from the top end of the image size in which an image appears. The exposure portion of the photosensitive drum surface is charged with the potential to the extent in which the toner is adhered, but the carrier is not adhered.

On the other hand, when it is a time t6 immediately before the recording starting position in the photosensitive drum surface reaches the developing area N, the bias voltage of the developing sleeve 21 is further superposed with the AC component instead of being conventionally just superposed with the DC component only. That is, the latent image starting point on the photosensitive drum surface, before reaching the developing area N by the rotation of the photosensitive drum 1, is superposed with the AC component on the DC component of the bias voltage.

In this manner, when the recording starting position passes through the developing area N, the development is performed by the bias voltage superposed with the AC component on the DC component which becomes high developing capability, comparing with the DC component only of the bias voltage.

The above described recording starting position indicates the beginning head of an image formable area, and in reality, even if no image exists in the beginning head of the image formable area, when the image formable area reaches the developing area N, the AC component is superposed on the bias voltage for the developing sleeve 21. However, in case the latent image formation is not performed from the beginning head of the image formable area, the AC component may be superposed on the bias voltage by waiting until immediately before the latent image starting point. In this manner, unnecessary adherence of the toner and the carrier can be further reduced.

Further, in the present embodiment, after the start of the driving of the developing sleeve 21, the superposing of the AC bias on the developing sleeve 21 is started. Although this may be performed in reverse, by setting this in the configuration of the present embodiment, inadvertent adherence of the toner and the carrier on the photosensitive drum 1 by the impact at the starting time of the driving of the developing sleeve can be controlled.

To sum up the bias voltage control at the recording operation starting time, after the pressing of a copy starting button, the driving of the photosensitive drum 1 is started, and the charging starts when the driving of the photosensitive drum 1 is stabilized. After that, before the top end of the charging portion of the photosensitive drum 1 reaches the developing area N, the DC component of the developing bias power source is applied, and after that, during a period of time in which the top end of the image size reaches the developing area portion, the driving of the developing sleeve 21 is started, and further, the DC component of the developing bias is superposed with the AC component, and after that, a developing step is performed.

Next, the bias voltage control at the recording operation stopping time will be described. Basically, if the control at the starting time is traced in reverse, the same effect can be obtained, and therefore, here, the repetition of the previous description is omitted, and timing only according to the timing chart of FIG. 3 will be briefly described.

At a time t7 of the timing chart shown in FIG. 3, a latent image formation by the exposure for one page for the photosensitive drum 1 is completed. After the completion of the latent image formation, though the rear end of the image formable area passes through the rear end of the developing area N by the rotation of the photosensitive drum 1, in the present embodiment, at a time t8 after the recording completing position passes through the developing area, the AC component only of the bias voltage is turned off in anticipation. Further, at a time t9 before the rear end of the charging portion reaches the developing area N, the rotational driving of the developing roller 3 is stopped. After that, at a time t10, the charge voltage of the charging device 2 is turned off.

At a time t11 immediately after the rear end of the charging portion by the charging device 2 subsequent to the turning off of the charge voltage passes through the developing area N by the rotation of the photosensitive drum 1, the DC component of the developing bias voltage is turned off. After that, at a time 12, the rotational driving of the photosensitive drum 1 is stopped.

The application timing and stopping timing of the AC component of the developing bias and the driving timing of the developing sleeve 21 are not limited to the above described configuration. The AC component of the developing bias may be superposed and applied by the same timing as the DC component, and subsequent to that, it may be applied by the timing in which the top end of the image part reaches the developing area N. The stopping timing also may be the same timing as the DC component, and it may be turned off around anywhere after the image part passes through the developing area N until the DC component of the developing bias is turned off. Even in such a configuration, the effect of the present invention is not reduced at all. However, if the timing described in the present embodiment is maintained, the adherence amount of the toner stripes image can be controlled in advance, and the problem can be made difficult to arise.

The timing of the driving of the developing sleeve 21 is also not limited to the configuration of the present embodiment, and it is not particularly limited if the developing sleeve 21 is driven in the midst of passing through the image part. After all, if the timing described in the present embodiment is maintained just the same, the adherence amount of toner stripes image can be controlled in advance, and the problem can be made hard to arise. Further, if the driving time is made as short as possible, there is also an advantage of the developer becoming hard to deteriorate.

As described above, in the configuration of the present embodiment, since priority is given to the prevention of the carrier adherence to the photosensitive drum 1, the toner stripes image is adhered before and behind the image part of the photosensitive drum 1. This toner stripes image is adhered with the toner of more than equivalent to a solid image, and moreover, its width is approximately to the extent of the developing area width.

Now, in the four-color full color electrophotographic system image forming apparatus as described in FIG. 1, if the timing configuration of the application and the stopping as described above is set up, a toner stripes image is formed before and behind the image part for each color. These toner stripes images, when the toner image of each color is transferred on the intermediate transfer belt 7 by the primary transfer rollers 5*a*, 5*b*, 5*c*, and 5*d*, are primary-transferred in order on the intermediate transfer belt 7 together by electrical operation and pressing force of the primary transfer rollers 5*a*, 5*b*, 5*c*, and 5*d*. In this manner, the toner image of each color is superposed on the intermediate transfer belt 7. Similarly to this, the toner stripes image of each color is also superposed on the intermediate transfer belt 7 unless timing is well considered. As a result, in the case of the present embodiment such as the four-color full color image forming apparatus, these toner stripes images are conveyed up to the secondary transfer developing area T2 with four-colors superposed following the rotation of the intermediate transfer belt 7.

In this manner, following the rotation of the intermediate transfer belt 7, the toner images of four-colors and the toner stripes image before and behind those toner image are conveyed up to the secondary transfer developing area T2. From among these images, though the toner images of four-colors are transferred on the transfer material P, the toner stripes image formed before and behind the image part does not contact the transfer material P, and therefore, it directly contacts the second transfer roller 9, and ends up being transferred on the secondary transfer roller 9 by its electrical operation and pressing force. As a result, the secondary transfer roller 9 is smeared.

As described in the paragraph of [the problems to be solved by the invention], the toner images superposed with the toner stripes images of four-colors of more than the loaded amount of the solid image have some images not removable by a simple cleaning operation, and waiting for the completion of the cleaning of the rear surface smear of the transfer material P or the secondary transfer roller 9 has caused the lowering of efficiency.

Here, the secondary transfer roller 9 and cleaning of this roller will be described.

The secondary transfer roller 9 is configured by two or more layers having at least an elastic rubber layer and a coating layer (surface layer). The elastic rubber layer is made from a foam layer in which carbon black of 0.05 to 1.0 mm in cell diameter is dispersed. The coating layer is made from a fluorine contained resin of 0.1 to 1.0 mm in thickness in which ion conductive polymer is dispersed, and in consideration of the conveyance property also of the transfer material P, surface roughness Rz is allowed to be Rz>1.5 μm.

Although the present invention can obtain effectiveness without depending on the mode of the surface layer of the secondary transfer roller 9, it is often the conventional case that the secondary transfer roller uses a roller having a coarsen surface layer in view of the conveyance property of the transfer material P.

In the present embodiment also, the secondary transfer roller 9 having a coarsen surface layer is used. The surface roughness of the surface layer is Rz=2.5 μm. However, in the case of a blade system in which the secondary transfer roller 9 of the surface roughness of this sort is used, and moreover, a cleaning blade is used as a roller cleaner to clean the secondary transfer roller 9, a low density toner such as a developing fog toner and the like adhered to the non image part by the developing device 4 can be removed. In contrast to this, to sufficiently clean a high density image such as a solid image superposed with the toners of four-colors, it is necessary to increase an abutting pressure and an abutting angle of the cleaning blade so as to increase a linear load at the developing area portion of the cleaning blade. However, since both secondary transfer roller and cleaning blade are formed by an elastic body, a friction force between both of them is large, and in case the linear load at the developing area portion is made large, there is a problem that torsion of the cleaning blade is prone to occur.

On the other hand, since the secondary transfer roller 9 of which the surface layer is coarsened is used, it is possible to adopt an electrostatic cleaning system using an electrostatic fur brush instead of the blade system. The electrostatic fur brush system is a system in which bias of polarity in reverse to the polarity of the toner is applied to a conductive fur brush so that the toner on the secondary transfer roller 9 is transferred on the fur brush, thereby performing a cleaning. According to this system, there is an advantage in that, since the top end of the fur brush enters the coarsened portion of the surface layer even for the secondary transfer roller 9 of which the surface layer is coarsened, excellent cleaning can be performed.

However, though the electrostatic fur brush has few restrictions with respect to the surface shape of the secondary transfer roller 9 which becomes a cleaning object, to perform electrostatic cleaning, a cleaning performance is inferior to the blade system, and therefore, it is difficult to sufficiently remove high density toner. Hence, after having cleaned high density image such as a solid image superposed with the toners of four-colors, there have been often the cases where the surface layer of the secondary transfer roller 9 is smeared with the toner, and the smearing toner is transferred on the transfer material P, thereby causing a rear surface smear and an image defect at the both sides copying time.

As described above, even in case the blade system is used as a roller cleaner 11 or the electrostatic cleaning system is used, particularly in the case of high density image such as the image superposed with the toners of four-colors, it has been feared that a problem such as smearing of the rear surface is caused.

Therefore, in the present embodiment, the following configuration is adopted.

In brief, on-off timing of the developing bias voltage is adjusted to be different for each color, so that the adherence of the toner stripes image created before and behind the image part is not superposed on the intermediate transfer belt 7. The detail will be described as follows.

When a four-color full color image is formed, the reason why the adherence of toner stripes image created before and behind the image part is superposed on the intermediate transfer belt 7 for each color is that the time from the DC application timing of the developing bias until the top end of the image part on the photosensitive drum reaches the developing area N, and the timing in which the rear end of the image part on the photosensitive drum passes through the developing area N until the DC application of the developing bias is turned off are not changed for each color, but are made the same timing.

Hence, in the present embodiment, at the recording operation starting time, for the time in which the top end of the image part reaches the developing area N, the application timing of the DC component of the developing bias to be applied in advance is made different for each color. Further, at the recording operation completing time, after the rear end of the image part passes through the developing area N, the timing in which the application of the DC component of the developing bias is turned off is made different for each color.

The top end of the image part referred to here is a top end position of the image size, and indicates a position constantly spaced from the top end of the transfer material size. Usually, this spacing may be different for each image forming apparatus, but may be almost the same for each color. Because if it were not made the same, the color shift of the final image might be created. Consequently, even in the present embodiment, the distance from the top end of the transfer material size to the top end of the image size is made the same for each color. Consequently, even if the top end of the image part described below is replaced by the top end of the transfer material size, the same discussion can be made. Naturally, though there is a minute time difference between the top end of the image size and the top end of the transfer material size, the conception of the present invention is applicable to either case. Describing further, assuming that there exists a device which intentionally makes the distance from the top end of the transfer material size to the top end of the image size different, it may be as well to shift the application timing of the developing bias for each color with the top end of the transfer material size as a starting point. What is important is that the toner stripes image of each color formed outside of the image part is not superposed one another. This holds true with the rear end of the image part.

Figure 4:
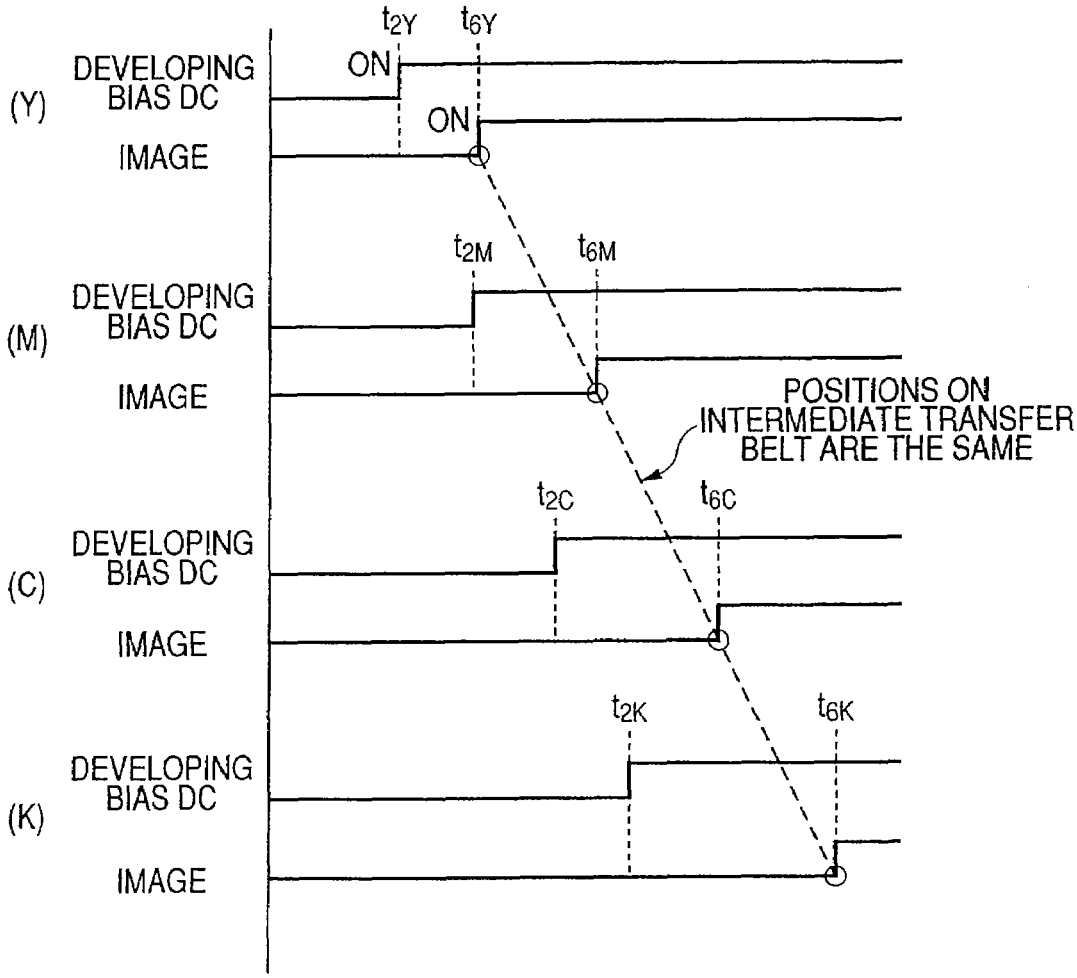
FIG. 4 is a time chart to explain an on-timing of a DC component of a developing bias voltage of Y, M, C, and M.

In FIG. 4 is shown a timing chart of each color relating to the recording starting time with important portions only put together. Although the times t6Y, t6M, t6C, and t6K in which the top end of the image part of each color of yellow (Y), magenta (M), cyan (C), and black (K) passes through the developing area N are different for each color, these times are the timing in which the images are superposed on the intermediate transfer belt 7. In the times t2Y, t2M, t2C, and t2K preceding these times, though the application of the DC component of the developing bias voltage is started, the present embodiment is characterized in that the DC application time (t2) of the developing bias voltage for the time (t6) in which the top end of the image part passes through the developing area N is shifted for each color.

The toner stripes image before the image part begins to be formed by the DC application timing of the developing bias. As described earlier, in the configuration where the developing sleeve 21 is driven after the top end of the charging portion reaches the developing area N similarly to the present embodiment, the toner stripes image is formed on the top end of the image part approximately with the same width as the developing area N, and therefore, the width of the toner stripes image does not depend on the application timing t3 of the charge voltage. Hence, the DC application time (t2) of the developing bias voltage for the time (t6) in which the top end of the image part passes through the developing area N is shifted for each color, so that the overlapping of the toner stripes images on the intermediate transfer belt 7 is prevented. This can be shown by the following formula.

$$|t2i-t6i| \neq |t2j-t6j| \quad (1)$$

(provided that i, j is either of Y, M, C, and K)

In order that the toner stripes image of the width of the developing area N is not superposed, it is preferable that the distance from the top end (image part top end) position of the image size to the toner stripes image on the photosensitive drum shifts more than the developing area width of the developing area N for each color. If this is turned into a time Ts, it is preferable that this time Ts shifts more than the time dividing the developing area width H by the process speed (peripheral speed) Vdr of the photosensitive drum. This can be shown by the following formula.

$$Ts=|(t2i-t6i)-(t2j-t6j)| \geqq H/Vdr \quad (2)$$

(provided that i, j is either of Y, M, C, and K)

Although there is effectiveness when either of the formulas (1) and (2) satisfies either one set from among Y, M, C, and K, if all is satisfied with respect to any of Y, M, C, and K, the toner stripes images of four-colors are not superposed with any of two colors, and this is most effective and preferable.

Further, with respect to |t2–t6|, it is preferable that the image forming part Sa disposed at the most upper stream along the moving direction of the intermediate transfer belt 7 is made most shortest. This is because, even in case |t2–t6| of the image forming parts Sb, Sc, and Sd other than the image forming part Sa of the most upper stream becomes slightly longer, a rising required time of the recording operation starting time does not become long, but the image forming part Sa only of the most upper stream directly affects on the rising required time.

Hence, in the present embodiment, as shown in FIG. 4, |t2–t6| of the image forming part Sa of yellow (Y) of the most upper stream is made the shortest.

Although the process speed Vdr of the photosensitive drum 1 is not particularly restricted, in the present embodiment, it is set to Vdr=300 mm/sec.

Figure 5:
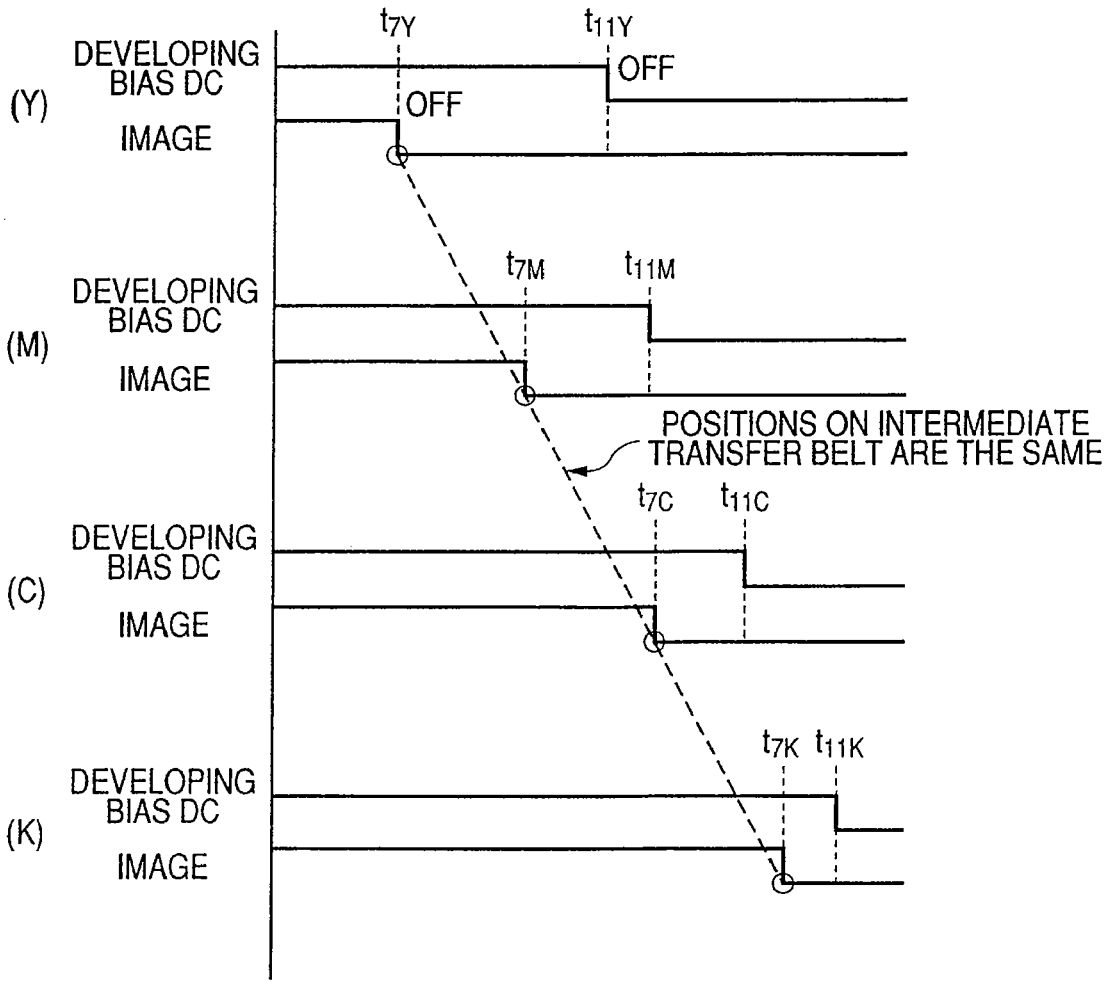
FIG. 5 is a time chart to explain an off-timing of the DC component of the developing bias voltage of Y, M, C, and M.

In FIG. 5 is shown a timing chart for each color relating to the recording operation completing time with important portions put together similarly to FIG. 4. In conformity to the conception of the present invention, the present embodiment is characterized in that a time Te from a time (t7) in which the rear end of the image forming part passes through the developing area N until the DC application off time (t11) of the developing bias voltage is shifted more than the time equivalent to the developing area width H for each color.

This can be shown by the following formula.

$$|t7i-t11i| \neq |t7j-t11j| \quad (3)$$

(provided that i, j is either of Y, M, C, and K)

$$Te=|(t7i-t11i)-(t7j-t11j)| \geqq H/Vdr \quad (4)$$

(provided that i, j is either of Y, M, C, and K)

With respect to the formulas (3) and (4) also, to satisfy any of Y, M, C, and K is highly effective in the present invention, but to satisfy any set alone of Y, M, C, and K is also effective.

Further, in view of not prolonging the falling operation, |t7–t11| of the black image forming part Sd of the most down stream is made the shortest.

The driving timing of the developing sleeve 21 and on off timing of the AC bias applications are not necessary to be changed for each color. Being not changed rather than changed can prevent unnecessary deterioration of the developer due to rotation of the developing sleeve 21 from being created, and can prevent the carrier and the toner from being adhered.

Further, the driving of the developing sleeve 12 is stopped during a period of the time from the recording stopping operation completing time until the next recording operating starting time, so that the toner stripes image is formed behind the image part at the recording operation completing time. On the other hand, the toner stripes image loading amount at the recording operation starting time can be sharply reduced. This is because the toner of the developing area N of the developing sleeve 21 is almost discharged at the recording operation completing time, and without the developer of the developing area N being replaced, the recording operation is started.

By adopting the above described configuration, the toner stripes image equivalent to the four-color solid image is no longer transferred on the secondary transfer roller 9 to be superposed, and the load of the roller cleaner 11 can be sharply reduced.

Here, the measuring method of the developing area width H referred to in the present invention will be described. In a state in which the photosensitive drum 1 and the developing device 4 are at a standstill, they are set against each other similarly to the usual normal image forming time, and after the DC component of the developing bias is applied, the developing device 4 is isolated. At this time, though the toner stripes image is formed on the photosensitive drum, the width from the most upper stream portion to the most down stream portion of the toner image on this photosensitive drum 4 is taken as the developing area width H. In the present embodiment, the developing area width H is 5 mm. In the present embodiment, since the same configuration is used for the developing device 4*a*, 4*b*, 4*c*, and 4*d* of each color, the developing area width H is 5 mm for each color. In case the configuration of the developing device is different for each color, and in case the setting (the developer coating amount per a unit area on the developing sleeve, the distance between the developing sleeve and the photosensitive drum, and the like) of the developing device is different, the developing area width H is different for each color. In this case, the toner stripes images adjacent on the intermediate transfer belt 7 are required to be spaced by the width portion only equivalent to the developing area width H of each color.

While the present embodiment has described the image forming apparatus to form a four-color full color image, the number of colors of the color image is not limited to this, and the embodiment is possible to be adapted to the image forming apparatus to form an image of plural colors of two or more colors. This holds true also with the following embodiment.

Second Embodiment

The present embodiment has the same configuration as the first embodiment. Hence, described mainly below are different points with the first embodiment.

In the present embodiment, when a toner stripes images of four-colors are conveyed to a secondary transfer developing area T2 following the rotation of an intermediate transfer belt 7 (see FIG. 1), and a secondary transfer roller 9 is applied with a secondary transfer bias voltage of the polarity in reverse to the usual polarity.

In the first embodiment, since the bias of the reverse polarity is not applied, the toner stripes image before and behind the image part is transferred on the second transfer roller 9. In the present embodiment, however, since the secondary transfer bias voltage of the reverse polarity is applied, the smearing of the second transfer roller 9 by the toner stripes image can be prevented.

However, in this case, in the down stream side of the secondary transfer developing area T2, the same problem arises in the belt cleaner 12 which is disposed to abut against the intermediate transfer belt 7 surface, and the smearing of the rear surface of the transfer material P and a lowering of efficiency arise.

Here, the intermediate transfer belt 7 and the belt cleaner 12 used in the present embodiment will be described.

In recent years, in the image forming apparatus using an electrostatic process, it has been sought-after to form high quality image for various types of transfer materials P. As a result, the intermediate transfer belt has been used widely. As the intermediate transfer belt, a belt made of synthetic resin represented by polyimide and the like has been widely used in view of characteristics of high image quality grade, high longevity, and high stability.

However, in the intermediate transfer belt made of synthetic resin, a hollow image phenomenon arising at the transferring time following the change of the toner has become a problem. The hollow image phenomenon is a phenomenon in which a high pressure is applied on the toner image when the toner image is transferred, so that the toner is deformed under stress, and the cohesive force between the toners is increased, and a portion of the toner image stays behind on the photosensitive drum without being transferred. Particularly, this phenomenon remarkably appears in characters and line images. In the case of the synthetic resin belt, since the pressure to the toner image at the transferring time is high, this hollow image has become a problem.

Hence, to eliminate this hollow image, in recent years, an elastic intermediate transfer belt using an elastic layer for the surface layer has become a mainstream instead of the intermediate transfer belt of synthetic resin. The elastic intermediate transfer belt is soft because of the elastic surface layer, and since the pressure acting on the toner at the transfer portion can be reduced, it has been known that the elastic intermediate transfer belt is effective for the hollow image. Further, in the secondary transfer developing area T2, because of excellent adhesiveness with the transfer material P, it has been known that the elastic intermediate transfer belt is effective not only for improvement of the transfer efficiency for the prevalent transfer material P, but also for transferability to cardboard and the transfer material P having unevenness.

However, in case the elastic intermediate transfer belt is cleaned, if the conventional blade system is used, because of the elastic surface layer, a friction load of the cleaning blade for the elastic intermediate transfer belt becomes large, and an edge top end of the cleaning blade ends up biting into the belt surface layer, and the behavior of the edge top end of the cleaning blade becomes unstable so as to cause a cleaning failure, and it has been feared that various adverse effects such as problems of curling up, chattering, squealing, and the like of the cleaning blade following the increase of the friction force between the belt and the cleaning blade, scratches on the elastic belt surface layer, development of fusion of the toner and the like occur, thereby disturbing the image quality.

Hence, to avoid the above described adverse effects, an electrostatic fur brush system having few contact load with the elastic intermediate transfer belt has come into general use as a cleaning system of the elastic intermediate transfer belt.

The electrostatic fur brush system is a method in which cylindrical members with a conductive fabric wound around a cored bar are abutted against each other in a state in which a bias is applied, and the bias of the polarity in reverse to the polarity of the toner is applied, so that the toner on the elastic intermediate transfer belt is absorbed and removed by the fur brush. This fur brush system, comparing with the blade system to mechanically remove the toner, is known to be limited in the toner amount cleanable and the toner polarity. The electrostatic fur brush system electrostatically absorbs the toner into the fur brush, and after that, unless the toner is further transferred from the fur brush by a flicker or a bias application roller and the like, the intrinsic performance of the fur brush is unable to be maintained. Hence, when the toner absorbing amount of the fur brush increases, the cleaning performance is lowered, and with respect to the cleanable amount in general, the fur brush system is inferior to the blade system. Further, as described above, since the fur brush system is a system to absorb the toner by the fur brush, and then, to start cleaning, it is only the toner of the polarity in reverse to the bias applied to the fur brush that is cleaned.

However, the transfer residual toner, which stays behind after the toner image on the elastic intermediate transfer belt is transferred on the transfer material, is often reversed in the polarity of the toner (from plus to minus or minus to plus) depending on the value of the bias added at the transferring time. The transfer residual toner reversed in the polarity in this manner, because of the same polarity with the applied bias of the fur brush, is not absorbed by the fur brush, but passes through the fur brush. The toner having passed through the fur brush overlaps the next image, and therefore, it is feared that an image defect is created. Hence, as disclosed in Japanese Patent Application Laid-Open No. 2002-207403, the fur brush is used two pieces, and each brush is applied with a bias of different polarity, so that whichever polarity minus or plus it is charged with depending on the bias of the secondary transfer developing area, usage environment, deterioration of the toner, and the like, the fur brush can reliably absorb and remove the toner.

In the present embodiment also, based on the conception as described above, the elastic intermediate transfer belt is used as the intermediate transfer belt 7, and moreover, two pieces of the fur brushes 12*a* and 12*b* (see FIG. 1) are used as the belt cleaner 12.

However, in the case of the fur brush system, as described above, the cleaning capability is inferior to the blade system, and therefore, the toner stripes image before and behind the image part, which is taken as the problem of the present invention, is difficult to be absorbed at a time.

Even in this case also, the present invention is effective, and similarly to the first embodiment, if the toner stripes image before and behind the image part of each color is disposed so as not to be superposed on the intermediate transfer belt by adjusting on off timing of the developing bias for each color, it is possible to sharply improve cleaning properties. As a result, a defect of the fur brush system worse in cleaning capability of a large amount of toner is compensated, while it is possible to make the best use of the advantage of having few chattering and squeaking.

While the present embodiment has described the configuration having the elastic intermediate transfer belt and the belt cleaner of the fur brush system, the effect of improving cleaning properties can be obtained also in the configuration using the resin belt instead of the elastic intermediate transfer belt and the configuration using the blade system instead of the fur brush system.

Third Embodiment

The present embodiment has almost the same configuration as the first and second embodiments. Hence, described mainly below are different portions with the first and second embodiments.

In the first and second embodiments, the developing bias power source applied to each developing sleeve 21 of the developing devices 3*a* to 3*d* is independently provided for each color, and on off of the application of the developing bias is performed by unique timing for each color.

Figure 6:
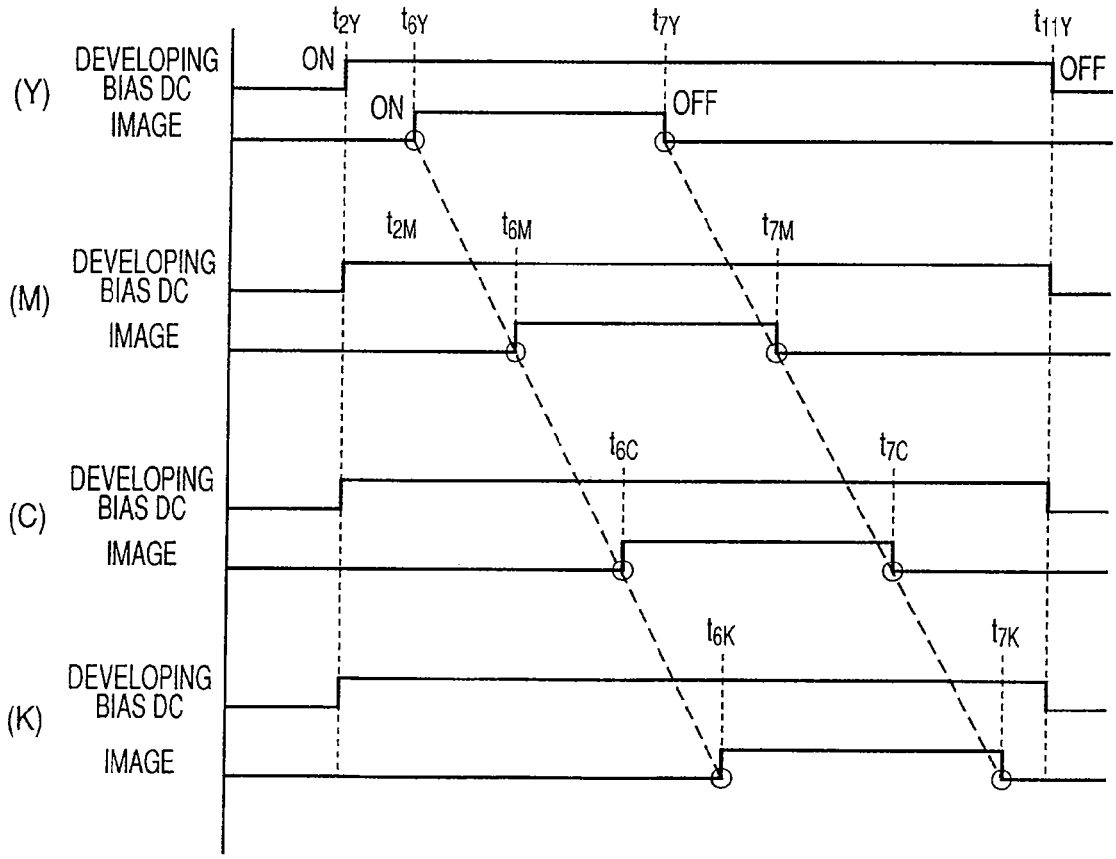
FIG. 6 is a time chart to explain another on-off timing of the DC component of the developing bias voltage of Y, M, C, and M.
Figure 7:
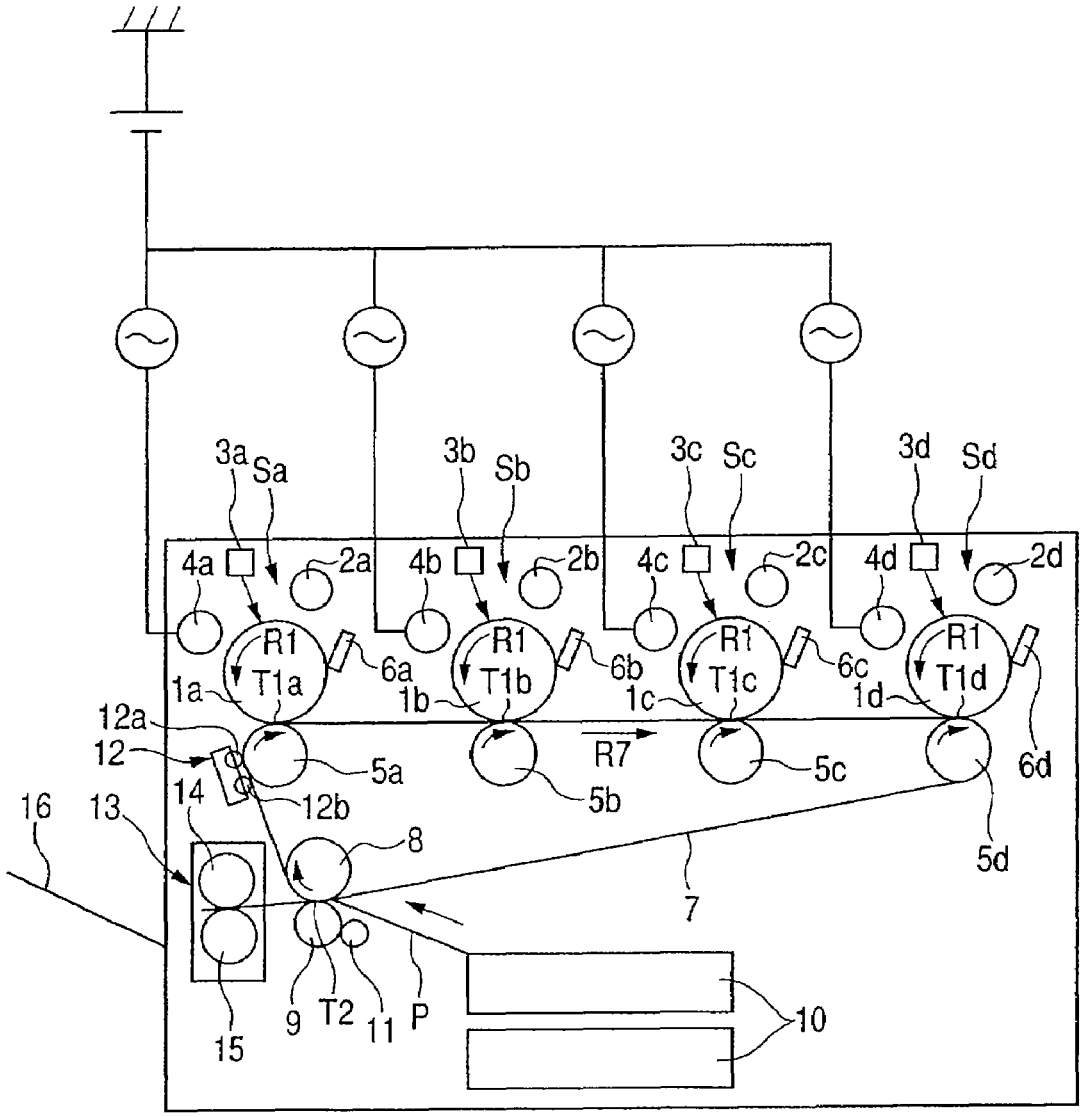
FIG. 7 is a longitudinal sectional view showing a schematic structure of the image forming apparatus of a third embodiment.

In the present embodiment, as shown in FIG. 7, the DC power source of the developing bias voltage is shared with four-colors. The timing chart at this time is shown in FIG. 6. Since the DC power source of the developing bias is shared with four-colors, on timing (t2) and off timing (t11) of the DC power source of the developing bias become the same time for four-colors.

Even in such configuration, as evident from FIG. 6, the formulas (1) to (4) are satisfied, and therefore, the effect of the present invention can be obtained. Moreover, because of the shared power source, it is possible to realize cost cutting.

At this time, as the power source of the charging device 2 is also shareable, it is shared in the present embodiment, and because of such configuration, further cost cutting can be realized.

In addition, the AC component power source of the developing bias voltage, the driving motor of the developing device, the driving motor of the photosensitive drum, and the like can be shared. However, for example, in case the driving motor of the developing device is shared, there is a problem in that an idling time of the developing device is prolonged as a whole.

In the first to third embodiments as described above, while a description has been made on the case where the intermediate transfer belt in the shape of a belt as an intermediate transfer member is used as an example, the present invention is not limited to this, and as the intermediate transfer belt, for example, a drum-shaped intermediate transfer drum can be also used. Even in this case, the same effect as the intermediate transfer belt can be obtained.

Fourth Embodiment

Further, in the first to third embodiments as described above, while a description has been made on the configuration using the intermediate transfer belt, such configuration can be adapted also to the image forming apparatus of a direct transfer system in which, instead of the intermediate transfer belt, a conveying belt (transfer material conveying means) of the transfer material P is used, and each color image formed on the photosensitive drums 1*a*, 1*b*, 1*c*, and 1*d* is superposed and transferred on the transfer material P borne and conveyed on the conveying belt.

Figure 8:
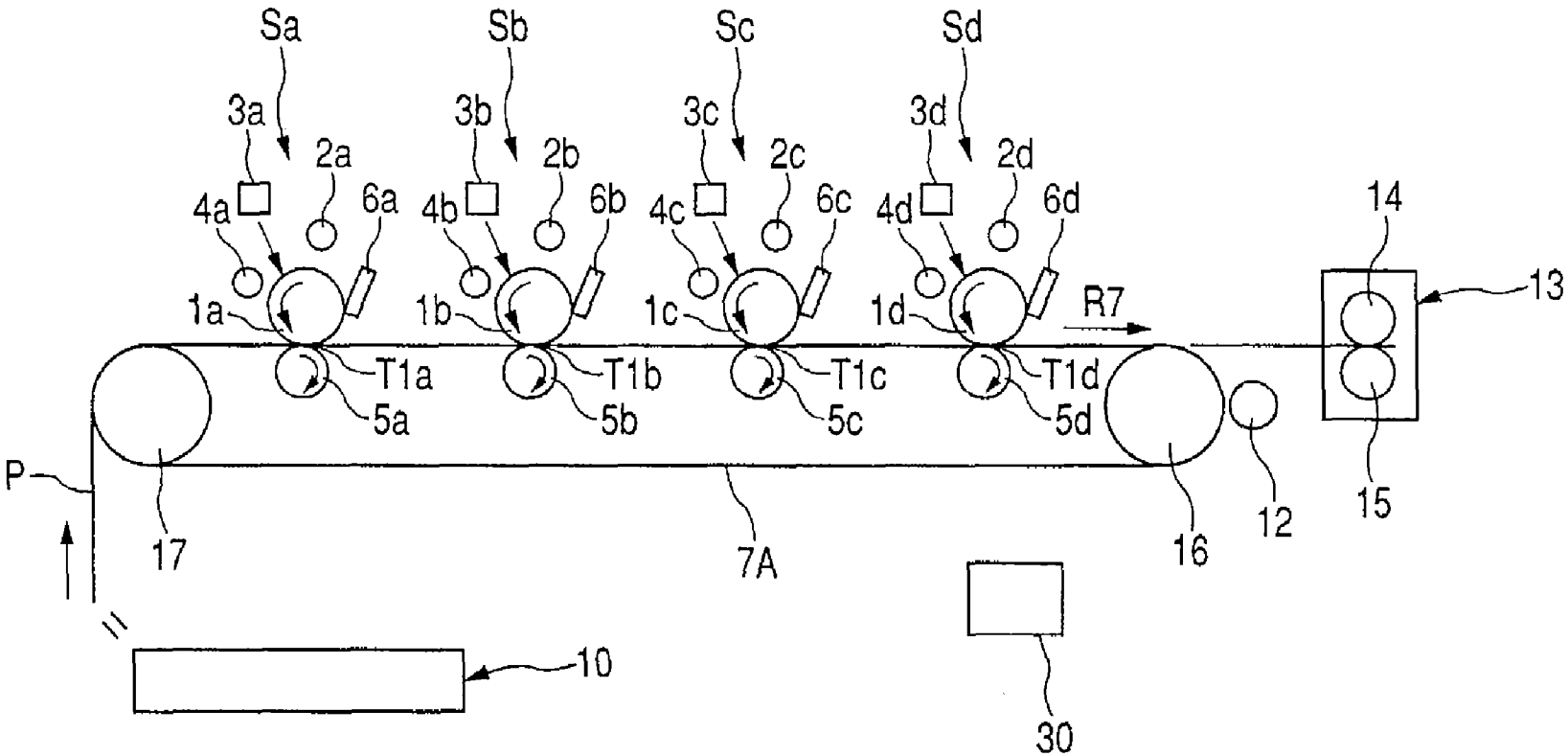
FIG. 8 is a longitudinal sectional view showing a schematic structure of the image forming apparatus of a fourth embodiment.

FIG. 8 representing the image forming apparatus of the direct transfer system is a schematic block diagram showing one embodiment of the image forming apparatus of the present invention.

In the Figure, a color image forming apparatus has in the device main body, for example, a first, a second, a third, and a fourth image forming parts Sa, Sb, Sc, and Sd capable of forming yellow, magenta, cyan, and black visual images (toner images) arranged in tandem, and each of the image forming parts Sa, Sb, Sc, and Sd comprises photosensitive drums 1*a*, 1*b*, 1*c*, and 1*d*, respectively. Each of the photosensitive drums 1*a*, 1*b*, 1*c*, and 1*d* has in its periphery dedicated an image forming part disposed such as primary charging devices 2*a*, 2*b*, 2*c*, and 2*d*, exposing devices 3*a*, 3*b*, 3*c*, and 3*d*, developing devices 4*a*, 4*b*, 4*c*, and 4*d*, transfer rollers 5*a*, 5*b*, 5*c*, and 5*d*, photosensitive drum cleaners 6*a*, 6*b*, 6*c*, and 6*d* and the like.

The transfer rollers 5*a*, 5*b*, 5*c*, and 5*d*, a driving roller 16, and a tension roller 17 are spanned with an endless transfer material conveying belt 7 as transfer material conveying means. The transfer material conveying belt 7 is pressed from its rear surface side by the transfer rollers 5*a*, 5*b*, 5*c*, and 5*d*, and the surface thereof is abutted against the photosensitive drums 1*a*, 1*b*, 1*c*, and 1*d*. In this manner, between the photosensitive drums 1*a*, 1*b*, 1*c*, and 1*d* and the transfer material conveying belt 7, transfer developing areas (transfer portions) T1*a*, T1*b*, T1*c*, and T1*d* are formed. The transfer material conveying belt 7, following the rotation of the driving roller 16, is rotated in the direction to an arrow mark R7. The rotational speed of this transfer material conveying belt 7 is set approximately to the same as the rotational speed (process speed) of each of the photosensitive drums 1*a*, 1*b*, 1*c*, and 1*d*.

The transfer material P conveyed on the transfer material conveying belt 7 from a paper feeding cassette 10 by a sheet feeding apparatus and a registration roller, following the rotation of the transfer material conveying belt 7, is supplied to transfer developing areas T1*a*, T1*b*, T1*c*, and T1*d* timed with the toner image on the photosensitive drum 1.

The toner images of four-colors formed at each of image forming parts Sa to Sd are transferred and superposed in order on the transfer material P conveyed on the transfer material conveying belt 7 by the transfer rollers 5*a*, 5*b*, 5*c*, and 5*d* in the primary transfer developing areas T1*a*, T1*b*, T1*c*, and T1*d*, thereby forming a full color image.

At this transferring time, the toner not transferred on the transfer material P but on the transfer material conveying belt 7 is removed by a belt cleaner 12 disposed by opposing to the driving roller 16. The toner stripes image formed before and behind the image part is not transferred on the transfer material P, but transferred on the transfer material conveying belt 7, and after that, is removed by the belt cleaner 12. In such configuration, when the toner stripes images as shown in the above described embodiments also are conveyed in a state in which plural toner stripes images are superposed, there is the possibility that those toner stripes images are not sufficiently cleaned. Hence, by the configuration as shown in the above described embodiments, the toner stripes images are disposed on the transfer material conveying belt 7 so as not to be superposed.

On the other hand, the transfer material P secondary-transferred with the toner images of four-colors is conveyed to a fixing apparatus 13, and here, these images are heated and pressured, so that the toner images are fixed on the transfer material P. Thus, the image formation of a four-color full color for one side (front surface) of a sheet of the transfer material P is completed.

In case such image forming apparatus of the direct transfer system is used, from among the descriptions of the first and third embodiments, if the intermediate transfer belt is taken as the transfer material conveying belt, and the belt cleaner to clean the intermediate transfer belt is replaced by the belt cleaner (transfer material conveying means cleaner) to clean the transfer material conveying belt, the description becomes approximately the same, and therefore, though not described here in detail, the same effect can be obtained.

Further, in the first to fourth embodiments as described above, while a description has been made on the four-color full color image forming apparatus as an example as the image forming apparatus adaptable to the present invention as an example, the present invention can be adapted to a so-called multi-color image forming apparatus to perform the image formation by the toner of two or more colors.

Fifth Embodiment

Figure 9:
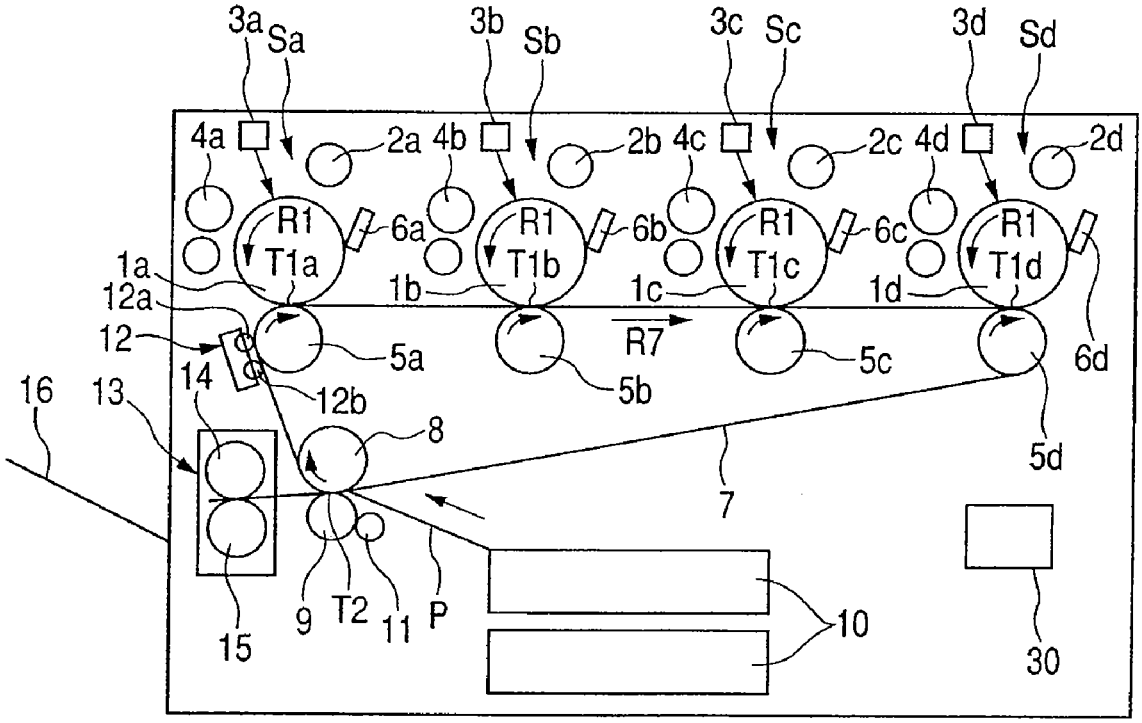
FIG. 9 is a longitudinal sectional view showing a schematic structure of the image forming apparatus applicable to the present invention.

In FIG. 9 is shown an image forming apparatus adaptable to the present invention. The image forming apparatus shown in the Figure is an image forming apparatus of a four-color full color electrophotographic system having four pieces of image forming parts, and the Figure is a longitudinal sectional view schematically showing its schematic structure.

The image forming apparatus shown in the Figure is disposed with four pieces of image forming parts (image forming stations) Sa, Sb, Sc, and Sd from the upper stream side to the down stream side along the rotational direction (direction to an arrow mark R7) of an intermediate transfer belt 7 as an intermediate transfer member.

Each of the image forming part Sa, Sb, Sc, and Sd is an image forming part to form a toner image of each color of yellow, magenta, cyan, and black in this order, and comprises an electrophotographic photosensitive member (hereinafter referred to as [photosensitive drum]) having a drum shape as image bearing members 1*a*, 1*b*, 1*c*, and 1*d*, respectively.

The photosensitive drums 1*a*, 1*b*, 1*c*, and 1*d* are rotationally driven in the direction to an arrow mark R1 (counterclockwise direction in FIG. 1), respectively. The circumference of each photosensitive drum 1*a*, 1*b*, 1*c*, and 1*d* is disposed with in order approximately along its rotational direction charging devices (charging means) 2*a*, 2*b*, 2*c*, and 2*d*, exposing apparatus (latent image forming means) 3*a*, 3*b*, 3*c*, and 3*d*, developing devices (developing means) 4*a*, 4*b*, 4*c*, and 4*d*, and primary transfer rollers (primary transfer means) 5*a*, 5*b*, 5*c*, and 5*d*, and drum cleaners (cleaning apparatus) 6*a*, 6*b*, 6*c*, and 6*d*. The primary transfer rollers 5*a*, 5*b*, 5*c*, and 5*d* and a secondary transfer opposing roller 8 are spanned with an endless intermediate transfer belt 7 as an intermediate transfer member. The intermediate transfer belt 7 is pressed from its rear surface by the primary transfer rollers 5*a*, 5*b*, 5*c*, and 5*d*, and its front surface is abutted against the photosensitive drums 1*a*, 1*b*, 1*c*, and 1*d*. In this manner, between the photosensitive drums 1*a*, 1*b*, 1*c*, and 1*d* and the intermediate transfer belt 7, there are formed primary transfer developing areas (primary transfer portions) T1*a*, T1*b*, T1*c*, and T1*d*. The intermediate transfer belt 7 is rotated in the direction to the arrow mark R7 following the rotation in the direction to an arrow mark of the secondary transfer opposing roller 8, which serves as a driving roller also. The rotational speed of this intermediate transfer belt 7 is set almost to the same rotational speed (process speed) of each of the photosensitive drums 1*a*, 1*b*, 1*c*, and 1*d*.

At a position corresponding to the secondary transfer opposing roller 8 in the surface of the intermediate transfer belt 7, there is disposed a secondary transfer roller (secondary transfer means) 9. The secondary transfer roller 9 developing areas the intermediate transfer belt 7 between it and the secondary transfer opposing roller 8, and between the secondary transfer roller 9 and the intermediate transfer belt 7, there is formed a secondary transfer developing area (secondary transfer portion) T2. Against this secondary transfer roller 9, there is abutted a roller cleaner (secondary transfer member cleaner) 11. Further, against the position corresponding to a primary transfer roller 5*a* in the surface of the intermediate transfer belt 7, there is abutted a belt cleaner (intermediate transfer member cleaner) 12.

A transfer material P supplied to the image formation is stored in a state loaded on a paper feeding cassette 10. This transfer material P is supplied to the secondary transfer developing area portion T2 by a sheet conveying apparatus having a paper feeding roller, a conveying roller, registration roller and the like (any one of them not illustrated). At the down stream side of the secondary transfer developing area portion T2 along the conveying direction of the transfer material P, there is disposed a fixing apparatus 13 having a fixing roller 14 and a pressure roller 15, and further at the down stream side of the fixing apparatus 13, there is disposed a sheet discharging tray 16.

In the image forming apparatus configured as described above, a four-color full color toner image is formed on the transfer material P in the following manner.

First, the photosensitive drums 1*a*, 1*b*, 1*c* and 1*d* are rotationally driven at a predetermined process speed in the arrow direction by a photosensitive drum driving motor (not shown), and are uniformly charged to predetermined polarity and potential by charging devices 2*a*, 2*b*, 2*c*, and 2*d*. The photosensitive drums 1*a*, 1*b*, 1*c*, and 1*d* after charged are subjected to exposure based on image information by exposing apparatuses 3*a* to 3*d*, and the electric charge of the exposed portion is removed, so that an electrostatic latent image of each color is formed.

These electrostatic latent images on the photosensitive drums 1*a*, 1*b*, 1*c*, and 1*d* are developed as the toner images of each color of yellow, magenta, cyan, and black by the developing devices 4*a*, 4*b*, 4*c*, and 4*d*. These four-color toner images are primary-transferred in order on the intermediate transfer belt 7 by the primary transfer rollers 5*a*, 5*b*, 5*c*, and 5*d* in the primary transfer developing areas T1*a*, T1*b*, T1*c*, and T1*d*. Thus, the four-color toner images are superposed on the intermediate transfer belt 7. At the primary transfer time, the toners (residual toners) not transferred on the intermediate transfer belt 7 but left behind on the photosensitive drums 1*a*, 1*b*, 1*c*, and 1*d* are removed by the drum cleaners 6*a*, 6*b*, 6*c*, and 6*d*. The photosensitive drums 1*a*, 1*b*, 1*c*, and 1*d* having been removed from the residual toners are supplied for the next image forming.

The four-color toner images superposed on the intermediate transfer belt 7 as described above are secondary-transferred on the transfer material P. The transfer material P conveyed from the paper feeding cassette 10 by the sheet conveying apparatus is supplied to the secondary transfer developing area T2 timed with the toner image on the intermediate transfer belt 7 by the registration roller. The supplied transfer material P is collectively secondary-transferred with the four-color toner images on the intermediate transfer belt 7 by the secondary transfer roller 9 in the secondary transfer developing area T2. At the secondary transfer time, the toners (residual toners) not transferred on the transfer material P but left behind on the intermediate transfer belt 7 are removed by the belt cleaner 12.

On the other hand, the transfer material P secondary-transferred with four-color toner images is conveyed to the fixing apparatus 13, and here, the transfer material P is heated and pressured, and is fixed with the toner images on the surface. The transfer material P after fixed with the toner images is discharged on the sheet discharge tray 16. Thus, the image formation of a four-color full color for one side (front surface) of a sheet of the transfer material P is completed.

Here, a portion relating to the present invention will be described in detail. In the following description, with respect to the photosensitive drums 1*a*, 1*b*, 1*c*, and 1*d*, the charging devices 2*a*, 2*b*, 2*c*, and 2*d*, the exposing apparatuses 3*a*, 3*b*, 3*c*, and 3*d*, the developing devices 4*a*, 4*b*, 4*c*, and 4*d*, the primary transfer rollers 5*a*, 5*b*, 5*c*, and 5*d*, and the drum cleaners 6*a*, 6*b*, 6*c*, and 6*d*, unless there is any particular need to distinguish colors, they are simply described as a photosensitive drum 1, a charging device 2, an exposing apparatus 3, a developing device 4, a primary transfer roller 5, and a drum cleaner 6.

In the present invention, as the developing device 4, the developing apparatus comprising two pieces of the developing sleeves is used. In case the developing device comprising plural developing sleeves is used, the toner stripes image is formed in a plurality for each color, and this increases the load of the cleaners of the secondary transfer roller and the intermediate transfer belt, and is particularly prone to cause a problem.

Figure 10:
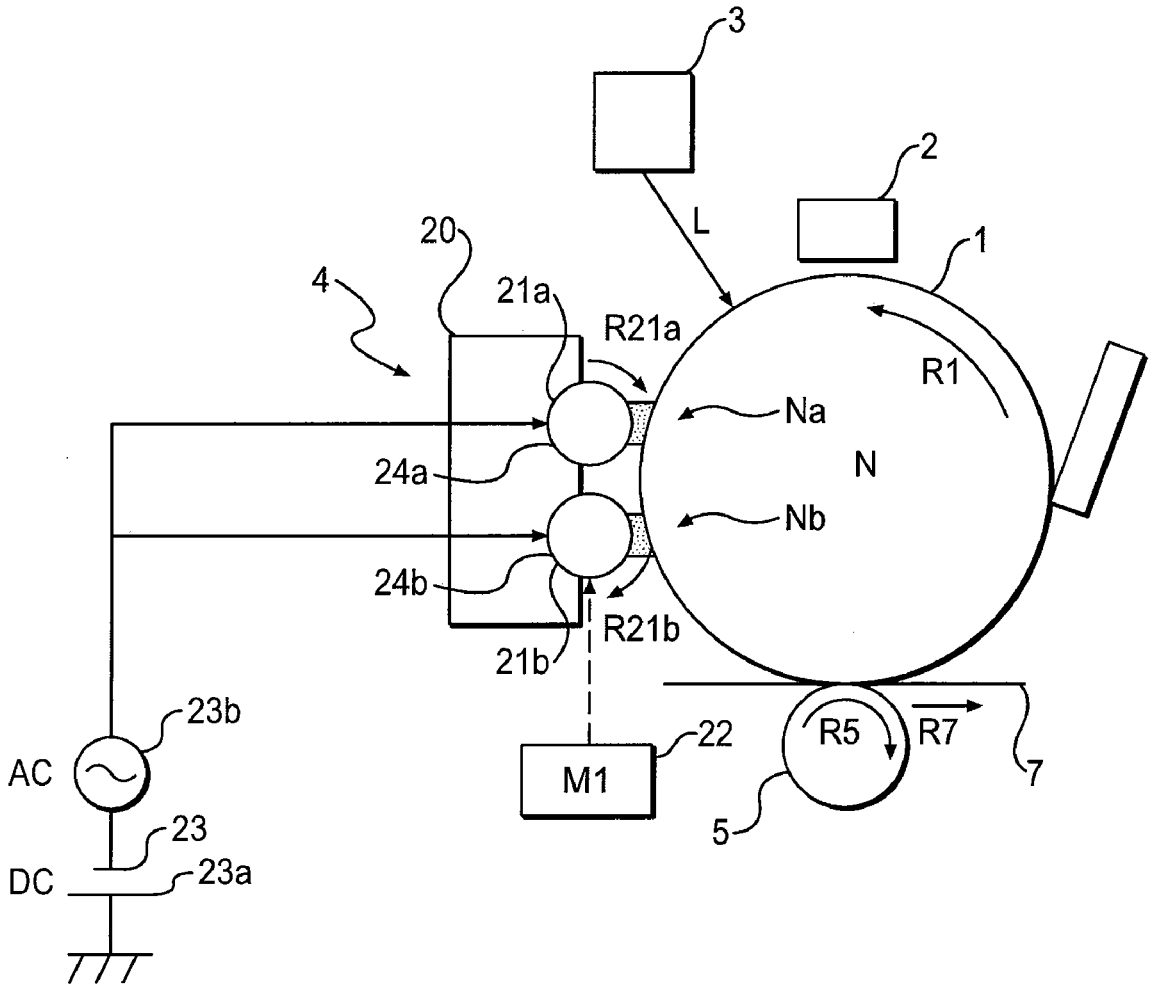
FIG. 10 is an enlarged longitudinal sectional view of the vicinity of the image forming apparatus.

In FIG. 10 is shown an enlarged view of the vicinity of the photosensitive drum 1.

When the image formation is performed, the photosensitive drum 1 is rotationally driven at a predetermined process speed in the direction to the arrow mark R1 by the photosensitive drum driving motor, and is uniformly charged to predetermined polarity and potential by the charging device 2. In the present embodiment, the photosensitive drum 1 is charged to a surface potential (dark portion potential) Vd=−700 [V]. The photosensitive drum 1 surface after charged receives an exposure L based on the image information by the exposing apparatus 3, and the electrical charge of the exposed portion is removed, thereby forming an electrostatic latent image. Hereinafter, a portion where the electrostatic latent image is formed by the exposure is referred to as "an image part (light portion)", and the portion wherein the exposure is not received is referred to as "a non-image part (dark portion)". This image part has a high potential (for example, the light portion potential V1=−200[V]), comparing with the non-image part.

The developing device 4 is disposed at the down stream side along the rotational direction (direction to the arrow mark R1) of the photosensitive drum 1 than the charging device 2. The charging device 4 has a developer container 20 to store a developer and two pieces of developing sleeves 21*a* and 21*b* which are the developer bearing member, and further, has a motor 22 to rotationally drive these developing sleeves 21*a* and 21*b* through a gear which is drive transmission means (not shown), and a developing bias applied power source 23 to apply a developing bias voltage to the developing sleeves 21*a* and 21*b*. From among two developing sleeves 21*a* and 21*b*, the developing sleeve 21*a* is disposed at the upper stream side along the rotational direction of the photosensitive drum 1, and the developing sleeve 21*b* is disposed at the down stream side. The surfaces of the developing sleeve 21*a* and 21*b* are carried with the toners charged negatively. Further, in the present embodiment, the developing sleeves 21*a* and 21*b* are branched with one developing bias applied power source 23 so as to be applied with the developing bias voltage. The developing bias applied power source 23 is configured by a direct current bias power source 23*a* and an alternating current bias power source 23*b*. By the application of the developing bias voltage of this developing bias applied power source 23, when the image part on the photosensitive drum 1 passes through the vicinity of the developing sleeves 21*a* and 21*b*, the toners carried on the surfaces of the developing sleeves 21*a* and 21*b* adhere to the image part on the photosensitive drum 1, thereby forming the toner images.

Heretofore, in the color image forming apparatus to form a full color image and a multi color image by the electrophotographic system, in view of coloring properties and color mixing properties, almost all the developing devices 4 use a two component developer mixing a toner and a carrier. In a two component developing process, the developer comprising the toner charged negatively and the carrier charged positively on the surface of the developing sleeve 21 is held. To fly this toner to the image part of the surface of the photosensitive drum 1, the developing bias voltage which is lower in potential than the image part but higher in potential than the non-image part is applied to the developing sleeve 21.

Particularly, in recent years, to improve developing capability, as the developing bias voltage of the developing sleeve 21, a (DC+AC) bias system to superpose the DC component (for example, Vdc=−550[V]) with an AC component (for example, 2.0 k [V]) has come to be adapted.

The difference between a dark portion potential Vd of the non-image part and the DC component Vdc of the developing bias is referred to as a fog taking potential Vback (=|Vd−Vdc|), and usually it is set to become approximately 100 to 200 [V]. If it is made smaller than this value, the non-image part becomes prone to be fogged. On the other hand, when it is made larger, the adherence amount of carrier is prone to increase. Further, the difference between a light portion potential V1 of the image part and the DC component Vdc of the developing bias is referred to as a contrast potential Vcont (=|V1−Vdc|) potential, and larger this contrast potential Vcont becomes, larger the loading amount of the toner on the photosensitive drum becomes. Usually, by adjusting this contrast potential, the density of the toner image on the photosensitive drum can be adjusted to the desired density.

The developing device 4 and the developer will be further described.

In the present embodiment, the developing device 4 adopts a two component magnetic brush system. Inside the developer container 20 of the developing device 4 shown in FIG. 2, there is stored a two component developer mainly comprising a magnetic carrier particle (suitably called as [carrier]) and a toner particle (suitably called as [toner]). Inside the developing sleeves 21*a* and 21*b*, there are disposed a magnet roller 24*a* and 24*b*, respectively. These magnet roller 24*a* and 24*b* are fixed, and the outer developing sleeves 21*a* and 21*b* are rotated in the directions to an arrow mark R21*a* and R21*b* by the motor 22. In the surfaces of the developing sleeve 21*a* and 21*b*, there are configured a magnetic brush of the two component developer by magnetic forces of the magnet rollers 24*a* and 24*b*. Between the photosensitive drum 1 surface and the developing sleeve 21*a* and 21*b* surfaces, there is provided a micro space.

The developing step of the toner is performed as follows. First, the developing sleeve 21*a* of the upper stream side located in the upper stream of the rotational direction of the photosensitive drum 1 (direction to the arrow mark R1) is rotated in the direction to the arrow mark R21*a* by the motor 22, so that the magnetic brush of the surface is slidably rubbed on or drawn near to the surface of the photosensitive drum 1. Further, the developing sleeve 21*a* of the upper stream side is applied with the developing bias voltage by the developing bias applied power source 23. In this manner, the toner inside the magnetic brush of the surface of the developing sleeve 21*a* of the upper stream side is adhered to the image part of the photosensitive drum 1, and this toner is developed as a toner image. The two component developer on the developing sleeve 21*a* of the upper stream side conveyed by the rotation of the developing sleeve 21*a* of the upper stream side is delivered to the developing sleeve 21*b* of the down stream side located in the down stream of the rotational direction (direction to the arrow mark R1) of the photosensitive drum 1, and the developing sleeve 21*b* of the down stream side is rotated in the direction to the arrow mark R21*b* by the motor 22, so that the magnetic brush of the surface is slidably rubbed on or closely drawn near to the surface of the photosensitive drum 1. The developing sleeve 21*b* is also applied with the developing bias voltage by the developing bias applied power source 23, and in this manner, the toner inside the magnetic brush of the surface of the developing sleeve 21*b* is adhered again to the image part on the photosensitive drum 1 conveyed by the rotation of the photosensitive drum 1, and this toner is developed again as a toner image.

In the present embodiment, the photosensitive drum 1 is 80 mm in diameter, and the developing sleeves 21*a* and 21*b* are 20 mm in diameter, and a distance at the closest area of approach (upper stream side developing area Na and the down stream side developing area Nb) between the surface of the photosensitive drum 1 and the surfaces of the developing sleeves 21*a* and 21*b* has been taken as approx 400 μm. In this manner, in a state in which the developer conveyed to the developing areas Na and Nb by the rotation in the direction to arrow marks R21*a* and R21*b* of the developing sleeves 21*a* and 21*b* is brought into contact with the photosensitive drum 1, the developing is allowed to be performed.

At this time, in the present embodiment, the developing bias voltage in which a direct current component (DC component) is superposed with an alternating current component (AC component) is applied to the developer sleeve 21 by a direct current bias power source 23*a* and an alternating current bias power source 23*b* of the developing bias applied power source. By applying such developing bias voltage, there is formed an oscillatory electric field between the photosensitive drum 1 and the developing sleeve 21. By this oscillatory electric field, the toner is separated, and is allowed to fly from the carrier. In the present embodiment, as the alternating current component, an alternating current bias of frequency f=12 kHz and peak to peak voltage Vpp=1.85 kV is used.

The two component developer including the toner and the carrier used in the present embodiment will be described.

The toner has a binding resin, a coloring agent, a coloring resin particle including other additive agents as required, and a coloring particle externally added with an external additive agent such as a colloidal silica particle. The toner is a polyester system resin of negative electric charge properties, and is preferably above 4 μm and below 10 μm in weight average particle diameter. More preferably, the toner is below 8 μm in weight average particle diameter.

Further, the carrier can preferably use, for example, iron of surface oxidation or unoxidation, nickel, cobalt, manganese, chrome, metals such as rare earths, alloy of these metals, oxide ferrite, and the like. The manufacturing method of these magnetic particles is not particularly limited. The carrier is 20 to 60 μm or preferably 30 to 50 μm in weight average particle diameter, and is above $10^7$ Ω·cm or preferably above $10^8$Ω·cm in electrical resistivity. In the present embodiment, the carrier of $10^8$Ω·cm is used.

With respect to the toner used in the present embodiment, the weight average particle diameter is measured by the device and the method shown below. As a measuring device, a coulter counter model TA-II (made by Coulter Electronics Limited), an interface (made by Nikkaki Bios Co. Ltd.) for outputting number average distribution and weight average distribution, and a CX-I personal computer (made by Cannon Inc.) are used, and as hydroelectric solution, 1% NaCl solution conditioned by using first grade sodium chloride is used.

The measuring method is as shown below. That is, as an interfacial active agent as an dispersing agent in the hydroelectric solution 100 to 150 ml, preferably alkylbenzene sulfonic acid is added 0.1 ml, and a measuring sample is added 0.5 to 50 mg. The hydroelectric solution in which the sample is suspended is subjected to decentralized processing approximately for one to three minutes by an ultrasonic distributor, and particle size distribution of particles of 2 to 40 μm is measured by using a 100 μm aperture as an aperture by the coulter counter model TA-II to find weight average distribution. By the weight average distribution thus found, the weight average particle size is obtained.

Further, resistivity of the carrier used in the present embodiment is measured by the method of obtaining the resistivity of the carrier from the electric current flowing in a circuit by applying an applied voltage E (V/cm) between both electrodes under pressure of the weight of 1 kg for one electrode by using a sandwich type cell which is 4 $cm^2$ in the measured electrode area and disposed at intervals of 0.4 cm between electrodes.

The photosensitive drum 1 used in the present embodiment uses a photosensitive drum, which is a drum-shaped organic photosensitive member of normal use, that is, a photosensitive drum in which the surface of a cylindrical drum main board made of aluminum is provided with an OPC (organic photo conductor) having negative electrical charge characteristics as an photosensitive layer. The photosensitive drum is not limited to this, and for example, it may be a non-organic photosensitive member mainly using selenium, silicon, carbon, and the like.

Here, referring to FIGS. 10 and 3, at the recording operation (image forming operation) starting time and the recording operation (image forming operation) stopping time, the content of a control of the developing bias voltage, a driving control of the photosensitive drum 1, and a driving control of the developing sleeve 21 will be described in detail. Such control of the operations of the developing device and the charging device is executed by control means 30.

In FIG. 3 is shown a timing chart of the photosensitive drum driving, charging, developing, exposing and the like from the recording operation start until the recording operation stopping in the case of copying (image forming) for a sheet of the transfer material P. The timing chart of FIG. 3 is written on the basis of the developing areas Na and Nb. To be specific, with respect to the recording operation starting time, the time in which the top ends of the charging portion and the image part reach the developing area Na at the upper stream side is taken as the charging on and the exposing on, and on the other hand, with respect to the recording operation stopping time, the moment in which each rear ends of the charging portion and the image part passes through the developing nit area Nb at the down stream side is taken as a timing of the charging off and the exposing off. Hence, precautions are needed to take note that these timing charts are different from an actual time axis.

First, at a time t0, a start key of the operation panel (any of the component parts not shown) of the image forming apparatus main body is depressed, and after that, at a time t1, the driving of the photosensitive drum driving motor is started.

When the time comes in which the photosensitive drum 1 transmitted with the rotational driving force of the photosensitive drum driving motor starts stably rotating, the charging device 2 is controlled to start applying the charge voltage (Vd=−700[V]) to the photosensitive drum 1. In this manner, the photosensitive drum surface passing through an opposing portion between the charging device 2 and the photosensitive drum 1 is charged to −700 [V]. This charging portion reaches the developing area N by the rotation of the photosensitive drum 1.

In the present embodiment, at a time t3 immediately before the top end of the rotational direction of the photosensitive drum from among the charging portions reaches the developing area Na of the upper stream side, a control is made such that the developing sleeve 21*a* of the upper stream side is applied with the DC component (Vdc=−550[V]) of the developing bias voltage.

The potential of the photosensitive drum surface located at the developing area Na at the time t3 becomes 0[V] because of a non-charging portion. On the other hand, the potential of the developing sleeve 21*a* is applied with DC bias of −550 [V], and the toner is adhered to the photosensitive drum surface located at the developing area Na at the contrast potential of Vcont=550[V]. Immediately after that, since the charging portion of the photosensitive drum surface charged with −750[V] enters the developing area Na, the developing area Na has the developing potential raised from −550[V] to +200V (=−550−(−750)). Hence, after that, the adherence of the toner to the photosensitive drum surface is stopped. As a result, the photosensitive drum surface located at the developing area Na is adhered with the toner stripes image. At this time, since two pieces of the developing sleeves 21*a* and 21*b* are applied with the developing bias voltage from the same power source 23, the developing sleeve 21*b* of the down stream side is also applied with the DC component of the developing bias voltage at the same time. As a result, the surface of the photosensitive drum located at the developing area Nb is also adhered with the toner stripes image.

If the developing bias voltage is applied after the charging portion passes through the developing area N, the adherence of the toner can be controlled. In its stead, the carrier coming to adhere to the surface of the photosensitive drum has been described in the paragraph of the Background Art. In the present embodiment also, in consideration of extensive harmful effects because of the carrier adherence, adherence of the toner stripes image is permitted by giving priority over the prevention of the carrier adherence.

The amount of toner adhered to the surface of the photosensitive drum at this time depends on a relative potential between the photosensitive drum surface and the developing sleeve surface in the developing area N. By turning the bias voltage of the developing sleeve 21 into the DC component only, comparing with the case where the bias voltage (DC+AC) superposed with the AC component on the DC component greatly higher in developing capability than the application of the DC component only is applied, the toner adherence amount can be sharply reduced.

Now, in the present embodiment, the DC component only is applied as the developing bias until the charging portion reaches the developing area N. In this manner, the adherence amount of the toner stripes image can be reduced. Further, in this manner, neither the carrier adherence amount is increased (on the contrary, the carrier also becomes difficult to adhere).

Further, in the present embodiment, as shown in FIG. 3, when the rotational driving of the photosensitive drum 1 is started at the time t1, the developing sleeve 21*a* and 21*b* rotationally driven by a driving system M1 different from this photosensitive drum 1 (see FIG. 10) are not yet rotationally driven. The developing sleeves 21*a* and 21*b* are controlled so as to be rotationally driven at a time t4 belonging to a period of time in which the top end of the image part reaches the developing area Na of the upper stream side after the top end of the charging portion passes through the developing area Nb of the down stream side. However, to perform such control, the distance from the top end of the charging portion to the top end of the image part on the photosensitive drum 1 is required to be kept longer than the distance from the top end of the developing area Na of the developing sleeve 21*a* of the upper stream side to the rear end of the developing area Nb of the developing sleeve 21*b* of the down stream side. This is derived from the fact that two pieces of the developing sleeves 21*a* and 21*b* are simultaneously driven. However, in the configuration where the developer is transferred between two developing sleeves, unless the developing sleeves 21*a* and 21*b* are simultaneously driven, the retention of the developer at the transfer portion of the developer is prone to occur with a result that a problem may be caused, and therefore, in the present embodiment, such configuration has been adapted.

If controlled in this manner after the top end of the charging portion passes through the developing area N the driving of the developing sleeve 21 is started, there are the following advantages. That is, during the passage of the charging portion through the developing area N, as described above, the development of the toner is performed by high contrast potential. At this time, when the developing sleeve 21 is driven, during this time, the developing portion is continuously supplied with the toner, and there is a possibility that the width of the toner stripes image is widened. Particularly, in the image forming apparatus having a high process speed, it is remarkable. On the other hand, during this time, if the driving of the developing sleeve 21 is stopped, the toner which flies from the developing sleeve 21 to the photosensitive drum 1 is almost the toner, which is adhered to the position in opposite to the photosensitive drum 1. Immediately after the bias voltage of the DC component is applied to the developing sleeve 21, the toner adhered to the position in opposite to the photosensitive drum 1 side flies over to the photosensitive drum 1 side, and at a point of time in which the belt of a developing area width is formed, no more toner is adhered to the drum 1, and therefore, the adhering width of the toner belt can be controlled to the extent of the developing area width.

When a predetermined period of time elapses from the time in which the DC component of the bias voltage is applied to the developing sleeve 21, a portion equivalent to the top end position of the transfer material P on the photosensitive drum surface reaches an exposing position by the rotation of the photosensitive drum 1. Further, when a predetermined period of time equivalent to the recording starting position from the top end of the transfer material elapses and comes to a time t5, the portion equivalent to the beginning head position (same as the top end of the image part) of an image size reaches an exposing position.

The exposing apparatus 3 completes the preparation of an electrostatic latent image formation by exposure by a time t5, and starts the formation of the electrostatic latent image from the top end of the image size in which an image appears. The exposure portion of the photosensitive drum surface is charged with the potential to the extent in which the toner is adhered, but the carrier is not adhered.

On the other hand, when it is a time t6 immediately before the recording starting position in the photosensitive drum surface reaches the developing area Na of the upper stream side, the bias voltage of the developing sleeve 21 is further superposed with the AC component instead of being conventionally just superposed with the DC component only. That is, the latent image starting point on the photosensitive drum surface, before reaching the developing area N by the rotation of the photosensitive drum 1, is superposed with the AC component on the DC component of the bias voltage.

In this manner, when the recording starting position passes through the developing area N, the development is performed by the bias voltage superposed with the AC component on the DC component which becomes high developing capability, comparing with the DC component only of the bias voltage.

The above described recording starting position indicates the beginning head of an image formable area, and in reality, even if no image exists in the top end of the image formable area, when the image formable area reaches the developing area N, the AC component is superposed on the bias voltage for the developing sleeve 21. However, in case the latent image formation is not performed from the beginning head of the image formable area, the AC component may be superposed on the bias voltage by waiting until immediately before the latent image starting point. In this manner, unnecessary adherence of the toner and the carrier can be further reduced.

Further, in the present embodiment, after the start of the driving of the developing sleeve 21, the superposing of the AC bias on the developing sleeve 21 is started. Although this may be performed in reverse, by setting this in the configuration of the present embodiment, inadvertent adherence of the toner and the carrier on the photosensitive drum 1 by the impact at the starting time of the driving of the developing sleeve can be controlled.

To sum up the bias voltage control at the recording operation starting time, after the pressing of a copy starting button, the driving of the photosensitive drum 1 is started, and the charging starts when the driving of the photosensitive drum 1 is stabilized. After that, before the top end of the charging portion of the photosensitive drum 1 reaches the upper stream developing area Na, the DC component of the developing bias power source is applied, and after that, during a period of time in which the top end of the charging portion passes through the rear end of the down stream developing area Na, and after that, the top end of the image size reaches the upper steam developing area portion Nb, the driving of the developing sleeve 21 is started, and further, the DC component of the developing bias is superposed with the AC component, and after that, a developing step is performed.

Next, the bias voltage control at the recording operation stopping time will be described. Basically, if the control at the starting time is traced in reverse, the same effect can be obtained, and therefore, here, the repetition of the previous description is omitted, and timing only according to the timing chart of FIG. 3 will be briefly described.

At a time t7 of the timing chart shown in FIG. 3, a latent image formation by the exposure for the photosensitive drum 1 is completed. After the completion of the latent image formation, though the rear end of the image formable area (image part) passes through the rear end of the developing area Nb by the rotation of the photosensitive drum 1, in the present embodiment, at a time t8 after the rear end of the image part passes through the down stream side developing area Nb, the AC component only of the bias voltage is turned off in anticipation. Further, at a time t9 before the rear end of the charging portion reaches the upper stream side developing area Na, the rotational driving of the developing sleeves 21*a* and 21*b* is stopped. After that, at a time t10, the charge voltage of the charging device 2 is turned off. To perform such a control, the distance from the rear end of the image part to the rear end of the charging portion on the photosensitive drum 1 is required to be kept longer than the distance from the top end of the developing area Na of the upper stream side developing sleeve 21*a* to the rear end of the developing area Nb of the down stream side developing sleeve 21*b*.

At a time t11 immediately after the rear end of the charging portion by the charging device 2 subsequent to the turning off of the charge voltage passes through the down stream side developing area Nb by the rotation of the photosensitive drum 1, the DC component of the developing bias voltage is turned off. After that, at a time t12, the rotational driving of the photosensitive drum 1 is stopped.

The application timing and stopping timing of the AC component of the developing bias and the driving timing of the developing sleeve 21 are not limited to the above described configuration. The AC component of the developing bias may be superposed and applied by the same timing as the DC component, and subsequent to that, it may be applied by the timing in which the top end of the image part reaches the developing area N. The stopping timing also may be the same timing as the DC component, and it may be turned off around anywhere after the image part passes through the developing area N until the DC component of the developing bias is turned off. Even in such a configuration, the effect of the present invention is not reduced at all. However, if the timing described in the present embodiment is maintained, the adherence amount of the toner stripes image can be controlled in advance, and the problem can be made difficult to arise.

The timing of the driving of the developing sleeve 21 is also not limited to the configuration of the present embodiment, and it is not particularly limited if the developing sleeve 21 is in the midst of passing through the image part. After all, if the timing described in the present embodiment is maintained just the same, the adherence amount of toner stripes image can be controlled in advance, and the problem can be made hard to arise. Further, if the driving time is made as short as possible, there is also an advantage of the developer becoming hard to deteriorate.

As described above, in the configuration of the present embodiment, since priority is given to the prevention of the carrier adherence to the photosensitive drum 1, the toner stripes image is adhered before and behind the image part of the photosensitive drum 1. This toner stripes image is adhered with the toner of more than equivalent to a solid image, and while, its width is approximately to the extent of the developing area width, in case the developing device 4 comprising two pieces of developing sleeves 21*a* and 21*b* similarly to the present embodiment is used, the toner stripes image to the extent of the width of two developing areas is adhered before and behind the image part.

Now, in the four-color full color electrophotographic system image forming apparatus as described in FIG. 9, if the timing configuration of the application and the stopping as described above is set up, a toner stripes image is formed before and behind the image part for each color. These toner stripes images, when the toner image of each color is transferred on the intermediate transfer belt 7 by the primary transfer rollers 5*a*, 5*b*, 5*c*, and 5*d*, are primary-transferred in order on the intermediate transfer belt 7 together by electrical operation and pressing force of the primary transfer rollers 5*a*, 5*b*, 5*c*, and 5*d*. In this manner, the toner image of each color is superposed on the intermediate transfer belt 7. Similarly to this, the toner stripes image of each color is also superposed on the intermediate transfer belt 7 unless timing is well considered. As a result, in the case of the present embodiment such as the four-color full color image forming apparatus, these toner stripes images are conveyed up to the secondary transfer developing area T2 with four-colors superposed following the rotation of the intermediate transfer belt 7.

In this manner, following the rotation of the intermediate transfer belt 7, the toner images of four-colors and the toner stripes image before and behind those toner image are conveyed up to the secondary transfer developing area T2. From among these images, though the toner images of four-colors are transferred on the transfer material P, the toner stripes image formed before and behind the image part does not contact the transfer material P, and therefore, it directly contacts the second transfer roller 9, and ends up being transferred on the secondary transfer roller 9 by its electrical operation and pressing force. As a result, the secondary transfer roller is smeared.

As described in the paragraph of [the problems to be solved by the invention], the toner images superposed with the toner stripes images of four-colors of more than the loaded amount of the solid image have some images not removable by a simple cleaning operation, and waiting for the completion of the cleaning of the rear surface smear of the transfer material P or the secondary transfer roller 9 has caused the lowering of efficiency.

Here, the secondary transfer roller 9 and cleaning of this roller will be described.

The secondary transfer roller 9 is configured by two or more layers having at least an elastic rubber layer and a coating layer (surface layer). The elastic rubber layer is made from a foam layer in which carbon black of 0.05 to 1.0 mm in cell diameter is dispersed. The coating layer is made from a fluorine contained resin of 0.1 to 1.0 mm in thickness in which ion conductive polymer is dispersed, and in consideration of the conveyance property also of the transfer material P, surface roughness Rz is allowed to be Rz>1.5 μm.

Although the present invention can obtain effectiveness without depending on the mode of the surface layer of the secondary transfer roller 9, it is often the conventional case that the secondary transfer roller uses a roller having a coarsen surface layer in view of the conveyance property of the transfer material P.

In the present embodiment also, the secondary transfer roller 9 having a coarsen surface layer is used. The surface roughness of the surface layer is Rz=2.5 μm. However, in the case of a blade system in which the secondary transfer roller 9 of the surface roughness of this sort is used, and moreover, a cleaning blade is used as a roller cleaner to clean the secondary transfer roller 9, a low density toner such as a developing fog toner and the like adhered to the non image part by the developing device 4 can be removed. In contrast to this, to sufficiently clean a high density image such as a solid image superposed with the toners of four-colors, it is necessary to increase an abutting pressure and an abutting angle of the cleaning blade so as to increase a linear load at the developing area portion of the cleaning blade. However, since both secondary transfer roller and cleaning blade are formed by an elastic body, a friction force between both of them is large, and in case the linear load at the developing area portion is made large, there is a problem that torsion of the cleaning blade is prone to occur.

On the other hand, since the secondary transfer roller 9 of which the surface layer is coarsened is cleaned, it is possible to adopt an electrostatic cleaning system using an electrostatic fur brush instead of the blade system. The electrostatic fur brush system is a system in which bias of polarity in reverse to the polarity of the toner is applied to a conductive fur brush so that the toner on the secondary transfer roller 9 is transferred on the fur brush, thereby performing a cleaning. According to this system, there is an advantage in that, since the top end of the fur brush enters the coarsened portion of the surface layer even for the secondary transfer roller 9 of which the surface layer is coarsened, excellent cleaning can be performed.

However, though the electrostatic fur brush has few restrictions with respect to the surface shape of the secondary transfer roller 9 which becomes a cleaning object, to perform electrostatic cleaning, a cleaning performance is inferior to the blade system, and therefore, it is difficult to sufficiently remove high density toner. Hence, after having cleaned high density image such as a solid image superposed with the toners of four-colors, there have been often the cases where the surface layer of the secondary transfer roller 9 is smeared with the toner, and the smearing toner is transferred on the transfer material P, thereby causing a rear surface smear and an image defect at the copying time.

As described above, even in case the blade system is used as a roller cleaner 11 or the electrostatic cleaning system is used, particularly in the case of high density image such as the image superposed with the toners of four-colors, it has been feared that a problem such as smearing of the rear surface is caused.

Therefore, in the present embodiment, the following configuration is adopted.

In brief, on-off timing of the developing bias voltage is adjusted to be different for each color, so that the adherence of the toner stripes image created before and behind the image part is not superposed on the intermediate transfer belt 7. The detail will be described as follows.

When a four-color full color image is formed, the reason why the adherence of toner stripes image created before and behind the image part is superposed on the intermediate transfer belt 7 for each color is that the time from the DC application timing of the developing bias until the top end of the image part on the photosensitive drum reaches the developing area N, and the timing in which the rear end of the image part on the photosensitive drum passes through the developing area N until the DC application of the developing bias is turned off are not changed for each color, but are made the same timing.

Hence, in the present embodiment, at the recording operation starting time, for the time in which the top end of the image part reaches the upper stream side developing area Na, the application timing of the DC component of the developing bias to be applied in advance is made different for each color.

Further, at the recording operation completing time, after the rear end of the image part passes through the down stream side developing area Nb, the timing in which the application of the DC component of the developing bias is turned off is made different for each color.

The top end of the image part referred to here is a top end position of the image size, and indicates a position constantly spaced from the top end of the transfer material size. Usually, this spacing may be different for each image forming apparatus, but may be almost the same for each color. Because if it were not made the same, the color shift of the final image might be created. Consequently, even in the present embodiment, the distance from the top end of the transfer material size to the top end of the image size is made the same for each color. Consequently, even if the top end of the image part described below is replaced by the top end of the transfer material size, the same discussion can be made. Naturally, though there is a minute time difference between the top end of the image size and the top end of the transfer material size, the conception of the present invention is applicable to either case. Describing further, assuming that there exists a device which intentionally makes the distance from the top end of the transfer material size to the top end of the image size different, it may be as well to shift the application timing of the developing bias for each color with the top end of the transfer material size as a starting point. What is important is that the toner stripes image of each color formed outside of the image part is not superposed one another. This holds true with the rear end of the image part.

In FIG. 4 is shown a timing chart of each color relating to the recording starting time with important portions only put together. Although the times t6Y, t6M, t6C, and t6K in which the top end of the image part of each color of yellow (Y), magenta (M), cyan (C), and black (K) arrives at the upper stream developing area Na are different for each color, these times are the timing in which the images are superposed on the intermediate transfer belt 7. In the times t2Y, t2M, t2C, and t2K preceding these times, though the application of the DC component of the developing bias voltage is started, the present embodiment is characterized in that the DC application time (t2) of the developing bias voltage for the time (t6) in which the top end of the image part arrives at the upper stream developing area Na is shifted for each color.

The toner stripes image before the image part begins to be formed by the DC application timing of the developing bias. As described above, in the configuration where the developing sleeves 21*a* and 21*b* are driven after the top end of the charging portion passes through the down stream side developing area Nb similarly to the present embodiment, the toner stripes image is formed two pieces on the top end of the image part approximately with the same width as the developing areas Na and Nb, and therefore, the width of these toner stripes images do not depend on the application timing t3 of the charge voltage. Hence, the DC application time (t2) of the developing bias voltage for the time (t6) in which the top end of the image part passes through the developing areas Na and Nb is shifted for each color, so that the overlapping of the toner stripes images on the intermediate transfer belt 7 is prevented. This can be shown by the following formula.

$$|t2i-t6i| \neq |t2j-t6j| \quad (1)$$

(provided that i, j is either of Y, M, C, and K)

Figure 11:
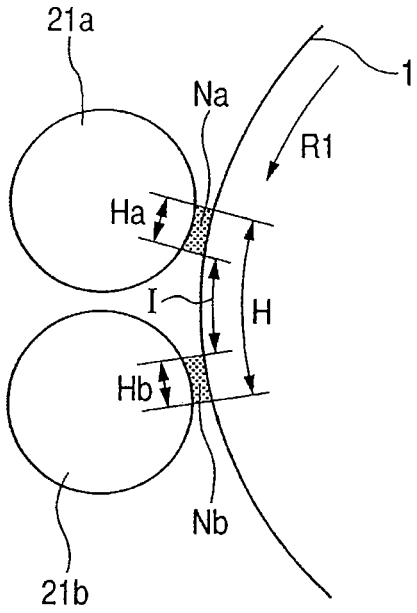
FIG. 11 is an enlarged sectional view of the developing area vicinity of a developing device.

Similarly to the present embodiment, in case the development is performed by using two pieces of developing sleeves 21*a* and 21*b*, since two pieces of toner stripes images are formed on the top end for each color, depending on shifting operation, there remains, for example, the possibility that the toner belt of the down stream side of Y (yellow) and the toner belt of the upper stream side of C (cyan) are superposed. Even in this case, though a load for the cleaner of the down stream is reduced comparing with the case where |t2−t6| is the same for each color and the toner belts for four-colors are completely superposed, if two pieces of belts of each color are disposed so as not to completely overlap, by that much the load is reduced, and it is preferable. In order not to completely overlap, the distance from the top end position (top end of the image part) of the image size to the toner stripes image on the photosensitive drum may take the width from the top end of the upper stream developing area Na formed by the upper stream side developing sleeve 21*a* to the rear end of the down stream developing area Nb formed by the down stream side developing sleeve 21*b* as a developing area width H, and it is preferable if the distance shits more than this developing area width H for each color (in FIG. 11 which is an enlarged view of the developing area is shown this developing area width H. The distance of FIG. 11 shows a distance on the photosensitive drum including the developing area width H. The measuring method will be shown later).

If this is turned into a time Ts, it is preferable if this time Ts shifts more than the time dividing the developing area width H by the process speed (peripheral speed) Vdr of the photosensitive drum 1. This can be shown by the following formula.

$$Ts=|(t2i-t6i)-(t2j-t6j)| \geqq H/Vdr \quad (2)$$

(provided that i, j is either of Y, M, C, and K)

Although there is effectiveness when either of the formulas (1) and (2) satisfies either one set from among Y, M, C, and K, if all is satisfied with respect to any of Y, M, C, and K, the toner stripes images of four-colors are not superposed with any of two colors, and this is most effective and preferable.

Further, with respect to |t2−t6|, it is preferable that the image forming part Sa disposed at the most upper stream along the moving direction of the intermediate transfer belt 7 is made most shortest. This is because, even in case |t2−t6| of the image forming parts Sb, Sc, and Sd other than the image forming part Sa of the most upper stream becomes slightly longer, a rising required time of the recording operation starting time does not become long, but the image forming part Sa only of the most upper stream directly affects on the rising required time.

Hence, in the present embodiment, as shown in FIG. 4, |t2−t6| of the image forming part Sa of yellow (Y) of the most upper stream is made the shortest.

Although the process speed Vdr of the photosensitive drum 1 is not particularly restricted, in the present embodiment, it is set to Vdr=300 mm/sec.

In FIG. 5 is shown a timing chart for each color relating to the recording operation completing time with important portions put together similarly to FIG. 4. In conformity to the conception of the present invention, the present embodiment is characterized in that a time Te from a time (t7) in which the top and rear ends of the image forming part passes through the down stream developing area Nb until the DC application off time (t11) of the developing bias voltage is shifted more than the time equivalent to the developing area width H for each color. The developing area width H referred to here is a width on the photosensitive drum 1 from the top end of the upper stream developing area Na formed by the upper stream developing sleeve 21*a* to the rear end of the down stream developing area Nb formed by the down stream side developing sleeve 21*b*.

This can be shown by the following formula.

$$|t7i-t11i| \neq |t7j-t11j| \quad (3)$$

(provided that i, j is either of Y, M, C, and K)

$$Te=|(t7i-t11i)-(t7j-t11j)| \geqq H/Vdr \quad (4)$$

(provided that i, j is either of Y, M, C, and K)

With respect to the formulas (3) and (4) also, to satisfy any of Y, M, C, and K is highly effective in the present invention, but to satisfy any set alone of Y, M, C, and K is also effective.

Further, in view of not prolonging the falling operation, |t7−t11| of the black image forming part Sd of the most down stream is made the shortest.

Figure 12:
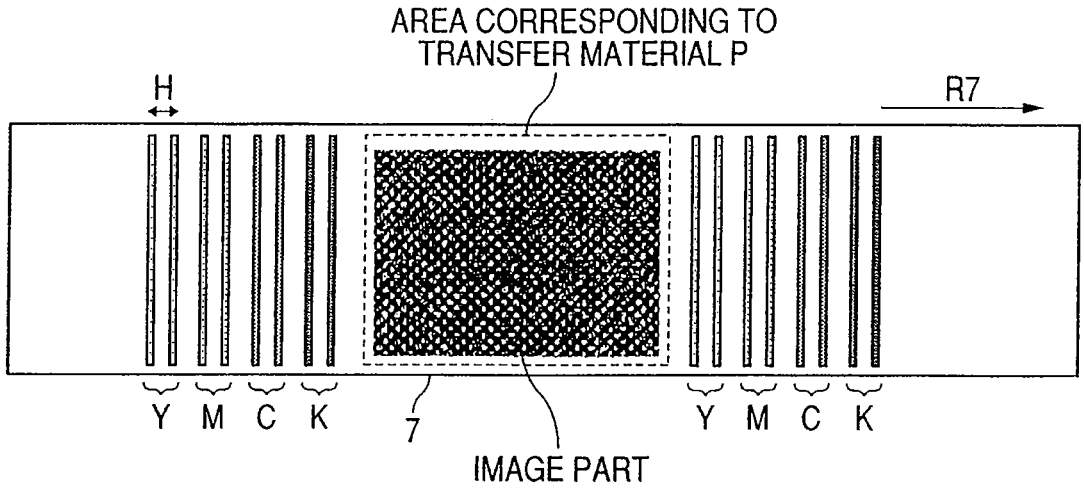
FIG. 12 is a view to explain one example of the embodiment.

In FIG. 12 is schematically shown an image to be formed on the intermediate transfer belt 7 in case the configuration of the above described embodiment is adapted. Before and behind the image part, there are formed the toner stripes images of each color deviated more than the developing area width H, and therefore, the toner images are not superposed.

The driving timing of the developing sleeve 21 and On-Off timing of the AC bias application are not required to be changed for each color. Being not changed rather than changed can prevent unnecessary deterioration of the developer due to rotation of the developing sleeve 21 from being created, and can prevent the carrier and the toner from being adhered.

Further, the driving of the developing sleeve 21 is stopped during a period of the time from the recording stopping operation completing time until the next recording operating starting time, so that the toner stripes image is formed behind the image part at the recording operation completing time. On the other hand, the toner stripes image loading amount at the recording operation starting time can be sharply reduced. This is because the toner of the developing area N of the developing sleeve 21 is almost discharged at the recording operation completing time, and without the developer of the developing area N being replaced, the recording starting operation is started.

By adopting the above described configuration, the toner stripes image equivalent to the four-color solid image is no longer transferred on the secondary transfer roller 9 to be superposed, and the load of the roller cleaner 11 can be sharply reduced.

Here, the measuring method of the developing area width H referred to in the present invention will be described. In a state in which the photosensitive drum 1 and the developing device 4 are at a standstill, they are set against each other similarly to the usual normal image forming time, and after the DC component of the developing bias is applied, the developing device 4 is isolated. At this time, though the toner stripes image is formed on the photosensitive drum 1, from among the toner images on this photosensitive drum 1, the width from the most upper stream potion of the toner image by the upper stream side developing sleeve 21*a* to the most down stream portion of the toner image by the downstream side developing sleeve 21*b* is taken as the developing area width H. In the present embodiment, the developing area width H is 30 mm. In the present embodiment, since the same configuration is used for the developing device 4*a*, 4*b*, 4*c*, and 4*d* of each color, the developing area width H is 30 mm for each color. In case the configuration of the developing device is different for each color, and in case the setting (the developer coating amount per a unit area on the developing sleeve, the distance between the developing sleeve and the photosensitive drum, and the like) of the developing device is different, the developing area width H is different for each color. In this case, the toner stripes images adjacent on the intermediate transfer belt 7 are required to be spaced by the width portion only equivalent to the developing area width H of each color.

While a description has been made on the case where the present embodiment mainly uses two pieces of developing sleeves, in case three or more sleeves are used, the upper stream side developing sleeve in the above description is changed to the most upper stream sleeve, and the down stream side developing sleeve is changed to the most down stream sleeve, the same effect can be obtained. At this time, even in case the developing area width H has several pieces of developing sleeves disposed between the most upper stream sleeve and the most down stream sleeve, it becomes the width from the most upper stream portion by the most upper sleeve to the most down stream portion of the toner image by the most down stream sleeve from among the toner images on the photosensitive drum 1.

In the present embodiment, since two pieces of the developing sleeves of each color are applied with the developing bias at the same timing from the same developing bias power source, the toner images before and behind the image part created by two pieces of the developing sleeves of each color are not superposed. On the other hand, in case two pieces of the developing sleeves are applied with the developing bias from a different power source, there is the possibility that the toner images are superposed, and therefore, precautions are needed so that the toner images are not timed to be superposed. Similarly to the present embodiment, if the configuration is such that plural developing sleeves are applied with the developing bias from the same bias power source, such concern is unnecessary.

Now, while the present invention has described about the image forming apparatus forming a four-color full color image, the number of colors of the color image is not limited to this, and the invention is adaptable to the image forming apparatus forming the image of plural number of colors of two or more colors. This holds true also with the following embodiment.

Sixth Embodiment

The present embodiment has almost the same configuration as the fifth embodiment. Hence, described mainly below are different points with the fifth embodiment.

In the present embodiment, when toner stripes images for four-colors are conveyed to a secondary transfer developing area T2 following the rotation of an intermediate transfer belt 7 (see FIG. 9), a secondary transfer roller 9 is applied with a secondary transfer bias voltage of the polarity in reverse to the usual polarity.

In the first embodiment, since the bias of the reverse polarity is not applied, the toner stripes image before and behind an image part is transferred on the secondary transfer roller 9, but in the present embodiment, since the secondary transfer bias voltage of the reverse polarity is applied, the smearing of the secondary transfer roller 9 by the toner stripes image can be prevented.

However, in this case, in the down stream side of the secondary transfer developing area T2, in a belt cleaner 12 disposed in such a manner as to abut against the surface of the intermediate transfer belt 7, the same problem occurs, and the smearing of the rear surface of the transfer material P and a lowering of efficiency occurs.

Here, the intermediate transfer belt 7 and the belt cleaner 12 used in the present embodiment will be described.

In recent years, in the image forming apparatus using an electrostatic process, it has been sought-after to form high quality image for various types of transfer materials P. As a result, the intermediate transfer belt has been used widely. As the intermediate transfer belt, a belt made of synthetic resin represented by polyimide and the like has been widely used in view of characteristics of high image quality grade, high longevity, and high stability.

However, in the intermediate transfer belt made of synthetic resin, a hollow image phenomenon arising at the transferring time following the change of the toner has become a problem. The hollow image phenomenon is a phenomenon in which a high pressure is applied on the toner image when the toner image is transferred, so that the toner is deformed under stress, and the cohesive force between the toners is increased, and a portion of the toner image stays behind on the photosensitive drum without being transferred. Particularly, this phenomenon remarkably appears in characters and line images. In the case of the synthetic resin belt, since the pressure to the toner image at the transferring time is high, this hollow image has become a problem.

Hence, to eliminate this hollow image, in recent years, an elastic intermediate transfer belt using an elastic layer for the surface layer has become a mainstream instead of the intermediate transfer belt of synthetic resin. The elastic intermediate transfer belt is soft because of the elastic surface layer, and since the pressure acting on the toner at the transfer portion can be reduced, it has been known that the elastic intermediate transfer belt is effective for the hollow image. Further, in the secondary transfer developing area T2, because of excellent adhesiveness with the transfer material P, it has been known that the elastic intermediate transfer belt is effective not only for improvement of the transfer efficiency for the prevalent transfer material P, but also for transferability to cardboard and the transfer material P having unevenness.

However, in case the elastic intermediate transfer belt is cleaned, if the conventional blade system is used, because of the elastic surface layer, a contact load of the cleaning blade for the elastic intermediate transfer belt becomes large, and an edge top end of the cleaning blade ends up biting into the belt surface layer, and the behavior of the edge top end of the cleaning blade becomes unstable so as to cause a cleaning failure, and it has been feared that various adverse effects such as problems of curling up, chattering, squealing, and the like of the cleaning blade following the increase of the friction force between the belt and the cleaning blade, scratches on the elastic belt surface layer, development of fusion of the toner and the like occur, thereby disturbing the image quality.

Hence, to avoid the above described adverse effects, an electrostatic fur brush system having few contact load with the elastic intermediate transfer belt has come into general use as the cleaning system of the elastic intermediate transfer belt.

The electrostatic fur brush system is a method in which cylindrical members with a conductive fabric wound around a cored bar are abutted against each other in a state in which a bias is applied, and the bias of the polarity in reverse to the polarity of the toner is applied, so that the toner on the elastic intermediate transfer belt is absorbed and removed by the fur brush. This fur brush system, comparing with the blade system to mechanically remove the toner, is known to be limited in the toner amount cleanable and the toner polarity. The electrostatic fur brush system electrostatically absorbs the toner into the fur brush, and after that, unless the toner is further transferred from the fur brush by a flicker or a bias application roller and the like, the intrinsic performance of the fur brush is unable to be maintained. Hence, when the toner absorbing amount of the fur brush increases, the cleaning performance is lowered, and with respect to the cleanable amount in general, the fur brush system is inferior to the blade system. Further, as described above, since the fur brush system is a system to absorb the toner by the fur brush, and then, to start cleaning, it is only the toner of the polarity in reverse to the bias applied to the fur brush that is cleaned.

However, the transfer residual toner, which stays behind after the toner image on the elastic intermediate transfer belt is transferred on the transfer material, is often reversed in the polarity of the toner (from plus to minus or minus to plus) depending on the value of the bias added at the transferring time. The transfer residual toner reversed in the polarity in this manner, because of the same polarity with the applied bias of the fur brush, is not absorbed by the fur brush, but passes through the fur brush. The toner having passed through the fur brush overlaps the next image, and therefore, it is feared that an image defect is created. Hence, as disclosed in Japanese Patent Application Laid-Open No. 2002-207403, the fur brush is used two pieces, and each brush is applied with a bias of different polarity, so that whichever polarity minus or plus it is charged with depending on the bias of the secondary transfer developing area, usage environment, deterioration of the toner, and the like, the fur brush can reliably absorb and remove the toner.

In the present embodiment also, based on the conception as described above, the elastic intermediate transfer belt is used as the intermediate transfer belt 7, and moreover, two pieces of the fur brushes 12*a* and 12*b* (see FIG. 9) are used as the belt cleaner 12.

However, in the case of the fur brush system, as described above, the cleaning capability is inferior to the blade system, and therefore, the toner stripes image before and behind the image part, which is taken as the problem of the present invention, is difficult to be absorbed at a time.

Even in this case also, the present invention is effective, and similarly to the first embodiment, if the toner stripes image before and behind the image part of each color is disposed so as not to be superposed on the intermediate transfer belt by adjusting on off timing of the developing bias for each color, it is possible to sharply improve cleaning properties. As a result, a defect of the fur brush system worse in cleaning capability of a large amount of toner is compensated, while it is possible to make the best use of the advantage of having few chattering and squeaking.

While the present embodiment has described the configuration having the elastic intermediate transfer belt and the belt cleaner of the fur brush system, the effect of improving cleaning properties can be obtained also in the configuration using the resin belt instead of the elastic intermediate transfer belt and the configuration using the blade system instead of the fur brush system.

Seventh Embodiment

The present embodiment has almost the same configuration as the fifth and sixth embodiments. Hence, described mainly below are different portions with the fifth and sixth embodiments.

In the first and second embodiments, the developing bias power source applied to each developing sleeve 21 of the developing devices 3*a* to 3*d* is independently provided for each color, and on off of the application of the developing bias is performed by unique timing for each color.

In the present embodiment, the DC power source of the developing bias voltage is shared with four-colors. The timing chart at this time is shown in FIG. 5. Since the DC power source of the developing bias is shared with four-colors, on timing (t2) and off timing (t11) of the DC power source of the developing bias become the same time for four-colors.

Even in such configuration, as evident from FIG. 11, the formulas (1) to (4) are satisfied, and therefore, the effect of the present invention can be obtained. Moreover, because of the shared power source, it is possible to realize cost cutting.

At this time, as the power source of the charging device 2 is also shareable, it is shared in the present embodiment, and because of such configuration, further cost cutting can be realized.

In addition, the AC component power source of the developing bias voltage, the driving motor of the developing device, the driving motor of the photosensitive drum, and the like can be shared. However, for example, in case the driving motor of the developing device is shared, there is a problem in that an idling time of the developing device is prolonged as a whole.

In the fifth to seventh embodiments as described above, while a description has been made on the case where the intermediate transfer belt in the shape of a belt as an intermediate transfer member is used as an example, the present invention is not limited to this, and as the intermediate transfer belt, for example, a drum-shaped intermediate transfer drum can be also used. Even in this case, the same effect as the intermediate transfer belt can be obtained.

Eighth Embodiment

The present embodiment has the same configuration as the fifth to seventh embodiments. Hence, described mainly below are different points with the fifth to seventh embodiments.

As described above, if the configuration is such that, at the recording operation starting time, before the charging portion passes through the developing area portion, the developing bias DC component only is applied, and after the charging portion passes through the developing area portion, the driving of the developing sleeve and the AC component application of the developing bias are performed, the toner adherence occurs centralizing mainly on the extent of the developing area width of each developing sleeve.

Hence, between the toner images (the distance thereof is equivalent to the distance between Ha and Hb of FIG. 11) created by the developing areas Na and Nb between the upper stream side developing sleeve 21*a* and the down stream side developing sleeve 21*b* of each color, there exists an area in which the toner adherence is few (the distance thereof is equivalent to I of FIG. 11). Hence, if an adjustment is made in such a manner that the area having few toner adherence between these toner images is utilized and a multi-color toner image is allowed to come there, without increasing a load on the cleaning, it is possible to narrow the width of the toner image where the toner image is formed at the image top and rear ends. That is, as described in the first embodiment, in case each color is disposed not to be superposed also between the developing areas Na and Nb of the upper stream side developing sleeve 21*a* and the down stream side developing sleeve 21*b*, through the top end and rear end of the image are formed with the toner image for four-colors stretching more than four times the distance (equivalent to H of FIG. 6) from the developing area most upper stream position of the upper stream side developing sleeve 21*a* to the developing area most down stream position of the down stream side developing sleeve 21*b*, on the other hand, if an adjustment is made in such a manner that the toner image of other colors comes into the toner image between the upper stream side developing sleeve 21*a* and the down stream side developing sleeve 21*b*, it is possible to reduce the toner image narrower than this width.

If this width can be reduced, a secondary transfer roller cleaner 11 for cleaning the toner images at the top end and rear end of the image (see FIG. 9), the driving of an intermediate belt cleaner 12, and the voltage application time can be reduced, and the time required for the recording operation starting and completing time can be reduced, and further, friction deterioration due to the driving of the secondary transfer roller 9 and an intermediate transfer belt 7, and current flow deterioration due to the voltage application can be reduced.

Figure 13:
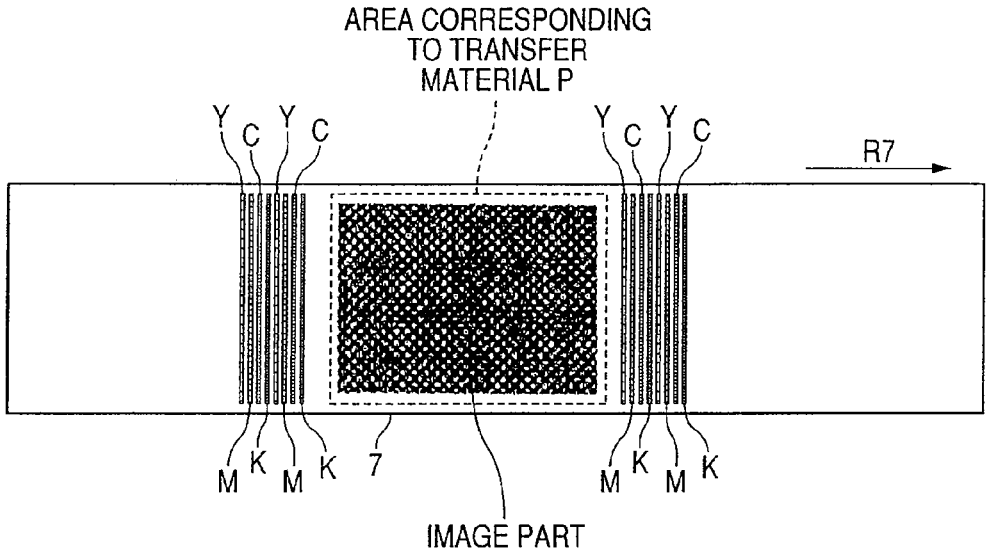
FIG. 13 is a view to explain another example of the embodiment.

Hence, in the present embodiment, as shown in FIG. 13, an adjustment of the application and stop timing of the developing bias is made such that toner images by the upper stream side developing sleeve of other three colors (M, C, and K) are formed between the toner image by the upper stream side developing sleeve formed by the developing area portion N of Y and the toner image by the down stream side developing sleeve.

To adopt such configuration, the toner images for three colors created by the upper stream side developing sleeve 21*a* must enter into the distance between the toner images created by the upper stream side developing sleeve 21*a* and the down stream side developing sleeve 21*b* of each color (the distance between the most down stream position of the upper stream side developing area Na and the most upper stream position of the downstream side developing area Nb on the photosensitive drum 1, which is equivalent to I in FIG. 6). Hence, the distance I between the toner images of each color must be larger than three pieces of the developing area width Ha of the upper stream side developing sleeve 21*a*.

This can be shown by the following formula.

$$I \geqq 3 \times Ha \tag{5}$$

Similarly, the distance must be larger than the three pieces of the developing area width Hb of the down stream sleeve 21*b*.

This can be shown by the following formula.

$$I \geqq 3 \times Hb \tag{6}$$

After all, it can be said that, in case of Ha≧Hb, the formula (5) may be satisfied, and in case of Ha≦Hb, the formula (6) may be satisfied.

In the present embodiment, since the configuration of the developing device is the same for four-colors, the developing area widths Ha and Hb are also the same for four-colors. Hence, the formulas (5) and (6) are used. In case the developing area widths Ha and Hb are different for each color because of different developing configuration and the like, the following formula is used.

$$Ii \geqq Haj + Hak + Hal \tag{7}$$

$$Ii \geqq Hbj + Hbk + Hbl \tag{8}$$

(provided that, i, j, k, and l are either of Y, M, C, and K. HaY indicates the developing area width Ha of the upper stream side developing sleeve of the developing device of Y. This holds true also with HaM, HaC, HaK, HbY, HbM, HbC, and HbK)

When the above described condition is satisfied, if the following formula is all satisfied with respect of any of Y, M, C, and K, the toner image is not superposed.

$$Ts = |(t2i - t6i) - (t2j - t6j)| \geqq Hx/Vdr \tag{9}$$

(provided that i, j is either of Y, M, C, and K) (when Ha≧Hb, Hx=Ha, and when Ha≦Hb, Hx=Hb)

If such configuration is adopted, the loads on the secondary transfer roller cleaner 11 located at the down stream of the image forming part and the intermediate transfer belt cleaner 12 can be reduced, and moreover, the widths of the toner images formed at the top end and rear end of the image part can be narrowed.

The distances I, Ha, and Hb can be simultaneously measured by the same measuring method of H described in the first embodiment.

While the present embodiment has described on the developing device using two pieces of sleeves, in case of using three or more pieces of the developing sleeves, with respect to any adjacent two pieces of developing sleeve, the formulas (5) to (9) may be satisfied. For example, in the case of the developing device comprising three pieces of developing sleeves, with respect to a first developing sleeve of the upper stream side of the rotational direction of the photosensitive drum and a second developing sleeve of the down stream side thereof, the formulas (5) to (9) may be satisfied, and further, with respect to the second developing sleeve and the third developing sleeve of the most down stream side also, the formulas (5) and (9) may be satisfied.

Further, while the present embodiment has described on the image forming apparatus comprising four-color image forming parts, the embodiment is also adaptable to the case where the number of colors of the color image is two or more colors. For example, in the case of n number of colors, the formula (5) and (6) become as follows:

$$I \geqq (n-1) \times Ha$$

$$I \geqq (n-1) \times Hb$$

Figure 14:
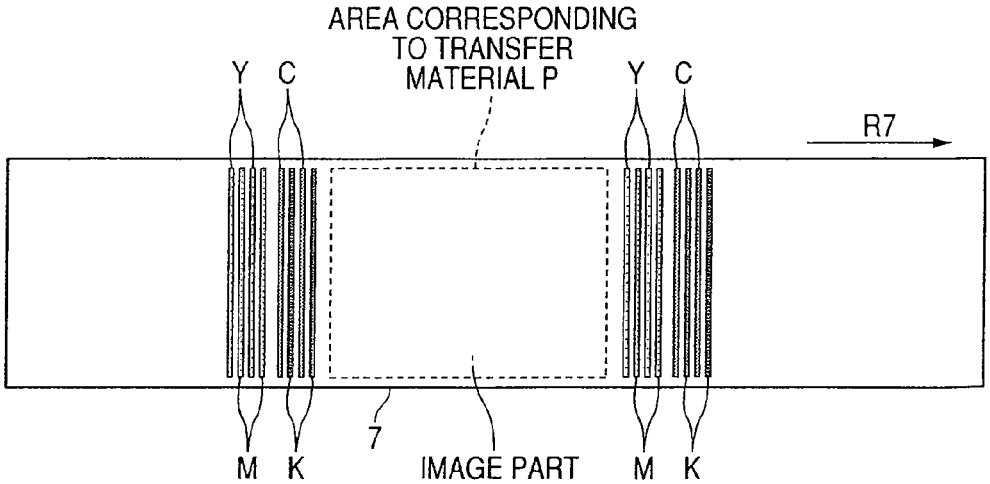
FIG. 14 is a view to explain another example of the embodiment.

Even in case the formulas (5) to (8) are not satisfied, as shown in FIG. 14, if a pair of Y and M and a pair of C and K alone are disposed so as to be superposed, the toner belt image widths of the top and rear ends of the image can be narrowed. Although various combinations including such combination are possible, according to the specification required for the device, the most suitable combination may be properly selected. What is important is that the toner images are disposed so as not to be superposed.

Ninth Embodiment

Further, in the fifth to eighth embodiments as described above, while a description has been made on the configuration using the intermediate transfer belt, the present invention is not limited to this, but can be also adapted to the image forming apparatus of a direct transfer system in which, instead of an intermediate transfer belt, a transfer material conveying belt (transfer material conveying means) bearing and conveying a transfer material P is used, and each color image formed on photosensitive drums 1*a* to 1*d* is superposed and transferred on the transfer material P borne and conveyed on the conveying belt.

In FIG. 8 is shown an example in case the present invention is adapted to the image forming apparatus of the direct transfer system. The figure is a view schematically showing the schematic structure of the image forming apparatus.

In the Figure, the image forming apparatus has in the device main body, for example, a first, a second, a third, and a fourth image forming parts Sa, Sb, Sc, and Sd capable of forming yellow, magenta, cyan, and black visual images arranged in tandem, and each of the image forming parts Sa to Sd comprises photosensitive drums 1*a*, 1*b*, 1*c*, and 1*d*, respectively. Each of the photosensitive drums 1*a*, 1*b*, 1*c*, and 1*d* has in its periphery dedicated an image forming part disposed such as primary charging devices 2*a*, 2*b*, 2*c*, and 2*d*, exposing devices 3*a*, 3*b*, 3*c*, and 3*d*, developing devices 4*a*, 4*b*, 4*c*, and 4*d*, transfer rollers 5*a*, 5*b*, 5*c*, and 5*d*, photosensitive drum cleaners 6*a*, 6*b*, 6*c*, and 6*d* and the like.

The transfer rollers 5*a*, 5*b*, 5*c*, and 5*d*, a driving roller 16, and a tension roller 17 are spanned with an endless transfer material conveying belt 18 as transfer material conveying means. The transfer material conveying belt 18 is pressed from its rear surface side by the transfer rollers 5*a*, 5*b*, 5*c*, and 5*d*, and the surface thereof is abutted against the photosensitive drums 1*a*, 1*b*, 1*c*, and 1*d*. In this manner, between the photosensitive drums 1*a*, 1*b*, 1*c*, and 1*d* and the transfer material conveying belt 18, transfer developing areas (transfer portions) T1*a*, T1*b*, T1*c*, and T1*d* are formed. The transfer material conveying belt 18, following the rotation of the driving roller 16, is rotated in the direction to an arrow mark R7. The rotational speed of this transfer material conveying belt 7 is set approximately to the same as the rotational speed (process speed) of each of the photosensitive drums 1*a*, 1*b*, 1*c*, and 1*d*.

The transfer material P fed from a paper feeding cassette 10 by a paper feeding apparatus (not shown) and conveyed on the transfer material conveying belt 18 by a registration roller (not shown), following the rotation of the transfer material conveying belt 18, is supplied to primary transfer developing areas T1*a*, T1*b*, T1*c*, and T1*d* timed with the toner image on the photosensitive drums 1*a*, 1*b*, 1*c*, and 1*d*.

The toner images of four-colors formed at each of image forming parts Sa to Sd are transferred and superposed in order on the transfer material P borne and conveyed on the transfer material conveying belt 18 by the transfer rollers 5*a*, 5*b*, 5*c*, and 5*d* in the primary transfer developing areas T1*a*, T1*b*, T1*c*, and T1*d*, thereby forming a full color image.

At this transferring time, the toner not transferred on the transfer material P but on the transfer material conveying belt 18 is removed by a belt cleaner 12 disposed by opposing to the driving roller 16. The toner stripes image formed before and behind the image part is not transferred on the transfer material P, but transferred on the transfer material conveying belt 18, and after that, is removed by the belt cleaner 12. At this time, the problem of the present invention arises.

On the other hand, the transfer material P secondary-transferred with the toner images of four-colors is conveyed to a fixing apparatus 13, and here, these images are heated and pressured, so that the toner images are fixed on the surface. Thus, the image formation of a four-color full color for one side (front surface) of a sheet of the transfer material P is completed.

In case such image forming apparatus of the direct transfer system is used, from among the descriptions of the first and fourth embodiments, if the intermediate transfer belt 7 is taken as the transfer material conveying belt 18, and the belt cleaner 12 to clean the intermediate transfer belt 7 is replaced by the belt cleaner (transfer material conveying means cleaner) 12 to clean the transfer material conveying belt 18, the description becomes approximately the same, and therefore, though not described here in detail, the same effect can be obtained.

This application claims priority from Japanese Patent Application Nos. 2004-306255 filed Oct. 20, 2004 and 2004-306258 filed on Oct. 20, 2004 which are hereby incorporated by reference herein.

What is claimed is:

1. An image forming apparatus, comprising:

a plurality of image forming parts, each of the plurality of image forming parts including:

an image bearing member on which an electrostatic image is formed;

a charging device that charges said image bearing member; and a developing device having a developer bearing member that bears developer including carrier and toner, wherein said developing device develops the electrostatic image by applying a developing bias to the developer bearing member;

an intermediate transfer member in which images, formed by each of said plurality of image forming parts, are sequentially superposed and transferred at transfer positions, wherein each of the transfer positions is a position in which one of said image bearing members of said plurality of image forming parts and said intermediate transfer member face each other;

a transfer member that transfers a toner image on said intermediate transfer member to a transfer material;

cleaning means to clean at least one of said intermediate transfer member and said transfer member; and a controller that, in each of said plurality of image forming parts, when application of developing bias into the developer bearing member is started according to a start of image forming, controls an operation of each of said plurality of image forming parts so as to start applying the developing bias before a leading edge of a charging area on said image bearing member charged by said charging device reaches a developing area in which the developer bearing member and said image bearing member face each other;

wherein, in each of said plurality of image forming part, a primary area is defined as an area in which said corresponding image bearing member faces the developer bearing member when a developing bias is applied into the developer bearing member according to the start of image forming, and in said intermediate transfer member, secondary areas are each defined as an area in which said intermediate transfer member faces the corresponding primary area of each of said image forming parts when the corresponding primary area passes through each of the transfer positions, and wherein said controller controls the operations of said plurality of image forming parts so that all of the secondary areas are not overlapped, or in a case where the secondary areas are overlapped, at least one of the secondary areas is not overlapped in an area in which all of the other secondary areas are all overlapped.

2. An image forming apparatus according to claim 1, wherein corresponding members, biases, and areas are defined as image bearing members, developing biases, and image forming areas in the same image forming part, and wherein assuming that Ts (sec) is defined for each image forming part as a time period from a time when the developing bias in that image forming part is staffed to be applied to a time when a leading edge of an image forming area on its corresponding said image bearing member in that image forming part reaches its corresponding developing area in that image forming part, H (mm) for each image forming part is defined as a width of said image bearing member in that image forming part in a moving direction of the width and Vdr (mm/sec) is defined for each image forming part as a peripheral speed of said image bearing member in that image forming part, each Ts in each of said plurality of image forming parts varies by an amount equal to or more than H/Vdr.

3. An image forming apparatus according to claim 1, wherein said controller starts driving each developer bearing member in each of said plurality of image forming parts after the leading edge of the charging area on its corresponding image bearing member in the same image forming part passes through the developing area in the same image forming part.

4. An image forming apparatus according to claim 2, wherein a time period from a time when the developing bias in the image forming part that forms a first image has stopped applying developer to a time when the leading edge of its corresponding charging area on its corresponding image bearing member in the same image forming part reaches its corresponding developing area in the same image forming part is the shortest time period of a plurality of time periods of said plurality of image forming parts each defined as the time when the developing bias in that image forming part has stopped applying developer to a time when the leading edge of its corresponding charging area on its corresponding image bearing member in that same image forming part reaches its corresponding developing area in that same image forming part.

5. An image forming apparatus according to claim 1, wherein the developing bias is a bias in which an alternating current component can be overlapped with a direct current component, and wherein said controller controls said developing device to start applying the direct current component before the leading edge of the charging area on said image bearing member reaches the developing area and to start applying the alternating current component after the leading edge of the charging area on said image bearing member reaches the developing area.

6. An image forming apparatus, comprising:

a plurality of image forming parts, each of said plurality of image forming parts including:

an image bearing member on which an electrostatic image is formed;

a charging device that charges said image bearing member; and a developing device that bears the electrostatic image with developer including carrier and toner on a developer bearing member and develops the electrostatic image by applying a developing bias to the developer bearing member;

an intermediate transfer member in which images, formed by each of said plurality of image forming parts, are sequentially superposed and transferred of transfer positions onto said intermediate transfer member, wherein each of the transfer positions is a position in which one of said image bearing members of said plurality of image forming parts and said intermediate transfer member face each other;

a transfer member that transfers a toner image on said intermediate transfer member to a transfer material;

cleaning means to clean at least one of said intermediate transfer member and said transfer member; and a controller that, in each of said plurality of image forming parts, when application of developing bias into the developer bearing member is stopped according to a stop of image forming, controls operations of said plurality of image forming parts so as to stop applying the developing bias after a trailing edge of a charging area on said image bearing member charged by said charging device presses through a developing area in which said developer bearing member and said image bearing member face each other in each of said plurality of image forming parts;

wherein, in each of said plurality of image forming parts, a primary area is defined as a an area in which said corresponding image bearing member faces the developer bearing member when the trailing edge of the charging area charged by said charging device passes through the developing area, and in said intermediate transfer member, secondary areas are each defined as an area in which said intermediate transfer member faces the corresponding primary area of each of said plurality of image forming parts when the corresponding primary area passes through each of the transfer positions, and wherein said controller controls the operations of said plurality of image forming parts so that all of the secondary areas are not overlapped, or in a case where the secondary areas are overlapped, at least one of the secondary areas is not overlapped in an area in which all of the other secondary areas are all overlapped.

7. An image forming apparatus according to claim 6, wherein corresponding members, biases, and areas are defined as image bearing members, developing biases, and image forming areas in the same image forming part, and wherein assuming that Ts (sec) is defined for each image forming part as a time period from a time when a trailing edge of an image forming area on said image bearing member in that image forming part reaches its corresponding developing area in that image forming part a time when the developing bias in that image forming part is stopped from being applied, H (mm) for each image forming part is defined as a width of said image bearing member in that image forming part in a moving direction of the width and Vdr (mm/sec) for each image forming part is defined as a peripheral speed of said image bearing member in that image forming part, each Ts in each of said plurality of image forming parts varies by an amount equal to or more than H/Vdr.

8. An image forming apparatus according to claim 6, wherein said controller stops driving each developer bearing member in each of said plurality of image forming parts before the trailing edge of the charging area on said image bearing member in the same image forming part passes through the developing area in the same image forming part.

9. An image forming apparatus according to claim 6, wherein a time period from a time when the trailing edge of the charging area on said image bearing member that forms a first image reaches the developing area in that same image forming part to a time when the developing bias in that same image forming part is stopped from being applied is the shortest time period of a plurality of time periods of said plurality of image forming parts each defined as a time period from a time when the trailing edge of a charging area on an image bearing member in that image forming part reaches the developing area in that same image forming part to a time when the developing bias in that same image forming part is stopped from being applied.

10. An image forming apparatus according to claim 6, wherein the developing bias is a bias in which an alternating current component can be overlapped with a direct current component, and said controller controls said developing device to stop applying the direct current component before the trailing edge of the charging area on said image bearing member reaches the developing area and to stop applying the alternating current component after the trailing edge of the charging area on said image bearing member reaches the developing area.

* * * * *